US006776408B2

(12) United States Patent
Suzuki et al.

(10) Patent No.: US 6,776,408 B2
(45) Date of Patent: Aug. 17, 2004

(54) SHEET DISCHARGE APPARATUS INCLUDING PRESSING MEMBER FOR GIVING WAVY SHAPE TO SHEET AND IMAGE FORMING APPARATUS INCLUDING THE SAME

(75) Inventors: Kazuhiro Suzuki, Yokohama (JP); Kouichi Akiyama, Fujisawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 79 days.

(21) Appl. No.: 10/102,099

(22) Filed: Mar. 19, 2002

(65) Prior Publication Data

US 2002/0135124 A1 Sep. 26, 2002

(30) Foreign Application Priority Data

Mar. 21, 2001 (JP) ..... 2001-081209
Mar. 6, 2002 (JP) ..... 2002-060850

(51) Int. Cl.[7] ..... B65H 29/70
(52) U.S. Cl. ..... 271/188; 271/303
(58) Field of Search ..... 271/303, 188

(56) References Cited

U.S. PATENT DOCUMENTS 3,087,724 A 4/1963 Snowdon et al.
5,201,518 A * 4/1993 Isoda ..... 271/305
6,181,908 B1 * 1/2001 Leemhuis et al. ..... 399/406

FOREIGN PATENT DOCUMENTS

| | | |
|---|---|---|
| EP | 0 611 719 A1 | 8/1994 |
| JP | 06-127776 A | 5/1994 |
| JP | 06-239002 A | 8/1994 |
| JP | 08-157125 A | 6/1996 |
| JP | 09-301590 A | 11/1997 |

* cited by examiner

*Primary Examiner*—Donald P. Walsh
*Assistant Examiner*—Kaitlin Joerger
(74) *Attorney, Agent, or Firm*—Frishauf, Holtz, Goodman & Chick, P.C.

(57) ABSTRACT

Provided is a sheet discharge apparatus including a plurality of stackers on which a sheet discharged from a conveyance passage is stacked, and a gate which changes a discharge direction of the sheet. The gate can move over a first changeover position to guide the sheet to one stacker, and a second changeover position to guide the sheet to the other stacker. When the gate is moved to the second changeover position, the sheet is guided to the other stacker through a bent guide passage. A pressing mechanism is disposed on an upstream side along a conveyance direction of the sheet from the gate. The pressing mechanism applies a pressure and gives a wavy shape to the sheet, and temporarily makes the sheet rigid as long as the gate is in the first position.

21 Claims, 14 Drawing Sheets

SHEET DISCHARGE APPARATUS INCLUDING PRESSING MEMBER FOR GIVING WAVY SHAPE TO SHEET AND IMAGE FORMING APPARATUS INCLUDING THE SAME

CROSS-REFERENCE TO RELATED APPLICATIONS

This application is based upon and claims the benefit of priority from the prior Japanese Patent Applications No. 2001-081209, filed Mar. 21, 2001; and No. 2002-060850, filed Mar. 6, 2002, the entire contents of both of which are incorporated herein by reference.

BACKGROUND OF THE INVENTION

1. Field of the Invention

The present invention relates to a sheet discharge apparatus for giving a wavy shape to a sheet and discharging the sheet, and an image forming apparatus with the sheet discharge apparatus mounted thereon, such as a laser printer or copying machine.

2. Description of the Related Art

An image forming apparatus such as a laser printer includes: an image processing mechanism for forming an image on a recording sheet; a conveyance passage for conveying the recording sheet with the image formed thereon; and a stacker for accumulating the recording sheets discharged from the conveyance passage. The image processing mechanism, conveyance passage and stacker are incorporated in a box-shaped apparatus body.

In this type of image forming apparatus, when a large amount of recording sheets are continuously conveyed, the recording sheets discharged from the conveyance passage are successively stacked and stored in the stacker. The recording sheet is thin and soft, and therefore inevitably curled, warped and deformed in the process of formation of the image or conveyance through the conveyance passage. When the recording sheets discharged from the conveyance passage are deformed in this manner, and stacked up in the stacker, the recording sheets are sometimes not aligned. As a result, the recording sheets are stacked up on the stacker in a disorderly manner, therefore look untidy, and cannot easily be removed from the stacker.

As an improvement measure, in the conventional image forming apparatus, a pressure is applied and a wavy shape is given to the recording sheet discharged via the conveyance passage by a plurality of rollers. Thereby, the recording sheet temporarily becomes rigid, and curls and deformation of the recording sheet are corrected. A concrete constitution for waving the recording sheet is disclosed, for example, in "Jpn. Pat. Appln. KOKAI Publication No. 9-301590", "Jpn. Pat. Appln. KOKAI Publication No. 8-157125", and "Jpn. Pat. Appln. KOKAI Publication No. 6-127776".

On the other hand, in this type of image forming apparatus, a so-called in-body discharge type is known in which a space for discharging the sheets is secured inside the apparatus body. The space for discharging the sheets is connected to the downstream end of the conveyance passage, and opened to the outside of the apparatus body. For the image forming apparatus, in order to perform an efficient sheet discharge operation, a pair of stackers, and a separator unit for distributing the recording sheet to either one of the stackers are disposed in the space.

The stackers are stacked up and disposed in the height direction of the apparatus body. The lower stacker is disposed in a position lower than the downstream end of the conveyance passage. The upper stacker is disposed in a position higher than the downstream end of the conveyance passage.

The separator unit includes a gate for switching the discharge direction of the recording sheet, and a guide passage connected to the upper stacker. The gate can be rotated between a first changeover position and a second changeover position. When the gate is rotated into the first changeover position, the recording sheet discharged in a horizontal direction from the conveyance passage is guided into the lower stacker. When the gate is rotated into the second changeover position, the recording sheet is guided into the guide passage via the gate. The guide passage guides the recording sheet discharged from the conveyance passage to the upper stacker. Therefore, the guide passage extends in a vertical direction, and has two corner portions midway. One corner portion is positioned in the upstream end of the guide passage, and guides upwards the recording sheet discharged in the horizontal direction from the conveyance passage. The other corner portion is positioned in the downstream end of the guide passage, and guides the recording sheet conveyed upwards along the guide passage horizontally toward the upper stacker.

Since the separator unit needs to be contained in the limited space of the apparatus body, particularly the total length of the guide passage is shortened. As a result, two corner portions for changing the conveyance direction of the recording sheet are disposed in the vicinity of each other, and the guide passage is steeply bent in a crank shape. Therefore, the recording sheet is forcibly bent twice while passed through the guide passage.

The recording sheet is pressed by the plurality of rollers and waved before being guided into the guide passage. When the waved recording sheet is passed through the guide passage, a force for forcibly deforming the sheet is applied to the temporarily rigid recording sheet. Thereby, the recording sheet generates a harsh sound as if something were broken. This abnormal sound makes a noise, and may discomfort the operator.

Furthermore, when the recording sheet is passed through the guide passage, the force for forcibly stretching the sheet flat is applied to the waved recording sheet. As a result, the recording sheet is not smoothly conveyed, and therefore wrinkled, and jamming is caused.

Jpn. Pat. Appln. KOKAI Publication No. 6-239002 discloses an improvement in waving the recording sheet discharged from the conveyance passage. In this prior art, a hump member for pressing the recording sheet is disposed in the downstream end of the conveyance passage. The hump member can selectively move to a raised position or a lowered position. When the hump member reaches the raised position, the hump member juts out on the conveyance passage, and presses the recording sheet. When the hump member reaches the lowered position, the hump member retreats from the conveyance passage. Therefore, the recording sheet is discharged from the conveyance passage without being hampered by the hump member.

However, in the prior art, a sheet discharge apparatus is assumed in which a sorter is selectively connected to the downstream end of the conveyance passage and used there. In detail, it is detected whether or not the sorter is connected to the downstream end of the conveyance passage, and the hump member is moved in accordance with the detected result. Therefore, in the prior art, the problem of the abnormal sound generated by the recording sheet during the guiding of the waved recording sheet through the bent guide passage is not recognized, and the necessity of muffling the abnormal sound generated by the deformation of the recording sheet is not taught.

BRIEF SUMMARY OF THE INVENTION

An object of the present invention is to provide a sheet discharge apparatus which can wave a sheet in accordance with a discharge direction of the sheet, and can prevent the sheet being conveyed from making an abnormal sound or from being wrinkled.

Another object of the present invention is to provide an image forming apparatus including the sheet discharge apparatus which can prevent the sheet being conveyed from making an abnormal sound or from being wrinkled.

To achieve the object, according to a first aspect of the present invention, there is provided a sheet discharge apparatus comprising: a conveyance passage to convey a sheet; a plurality of stackers on which the sheet discharged from the conveyance passage is stacked; and a gate which changes a discharge direction of the sheet discharged from the conveyance passage. The gate can move over a first changeover position to guide the sheet to one stacker, and a second changeover position to guide the sheet to the other stacker. The sheet is guided to the other stacker through a guide passage when the gate is moved to the second changeover position. The guide passage has a bent shape. Pressing means is disposed on an upstream side from the gate along a conveyance direction of the sheet. The pressing means applies a pressure and gives a wavy shape to the sheet, and temporarily makes the sheet rigid, when the gate is moved to the first changeover position.

To achieve the object, according to a second aspect of the present invention, there is provided an image forming apparatus comprising: an apparatus body in which an image processing mechanism is disposed to form an image on a sheet; a conveyance passage which is disposed in the apparatus body, and through which the sheet with the image formed thereon is conveyed; a plurality of stackers which are disposed in the apparatus body, and on which the sheet discharged from the conveyance passage is stacked; and a gate which changes a discharge direction of the sheet discharged from the conveyance passage. The gate can move over a first changeover position to guide the sheet to one stacker, and a second changeover position to guide the sheet to the other stacker. The sheet is guided to the other stacker through a guide passage, when the gate is moved to the second changeover position. The guide passage has a bent shape. Pressing means is disposed on an upstream side from the gate along a conveyance direction of the sheet. The pressing means applies a pressure and gives a wavy shape to the sheet, and temporarily makes the sheet rigid, when the gate is moved to the first changeover position.

According to the constitution, as long as the gate is moved to the second changeover position, the wave shape is not given to the sheet guided to the guide passage from the conveyance passage. Therefore, the sheet is smoothly conveyed without applying an unnecessary force to the sheet passed through the guide passage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A first embodiment of the present invention will be described hereinafter based on FIGS. 1 to 13.

Figure 1:
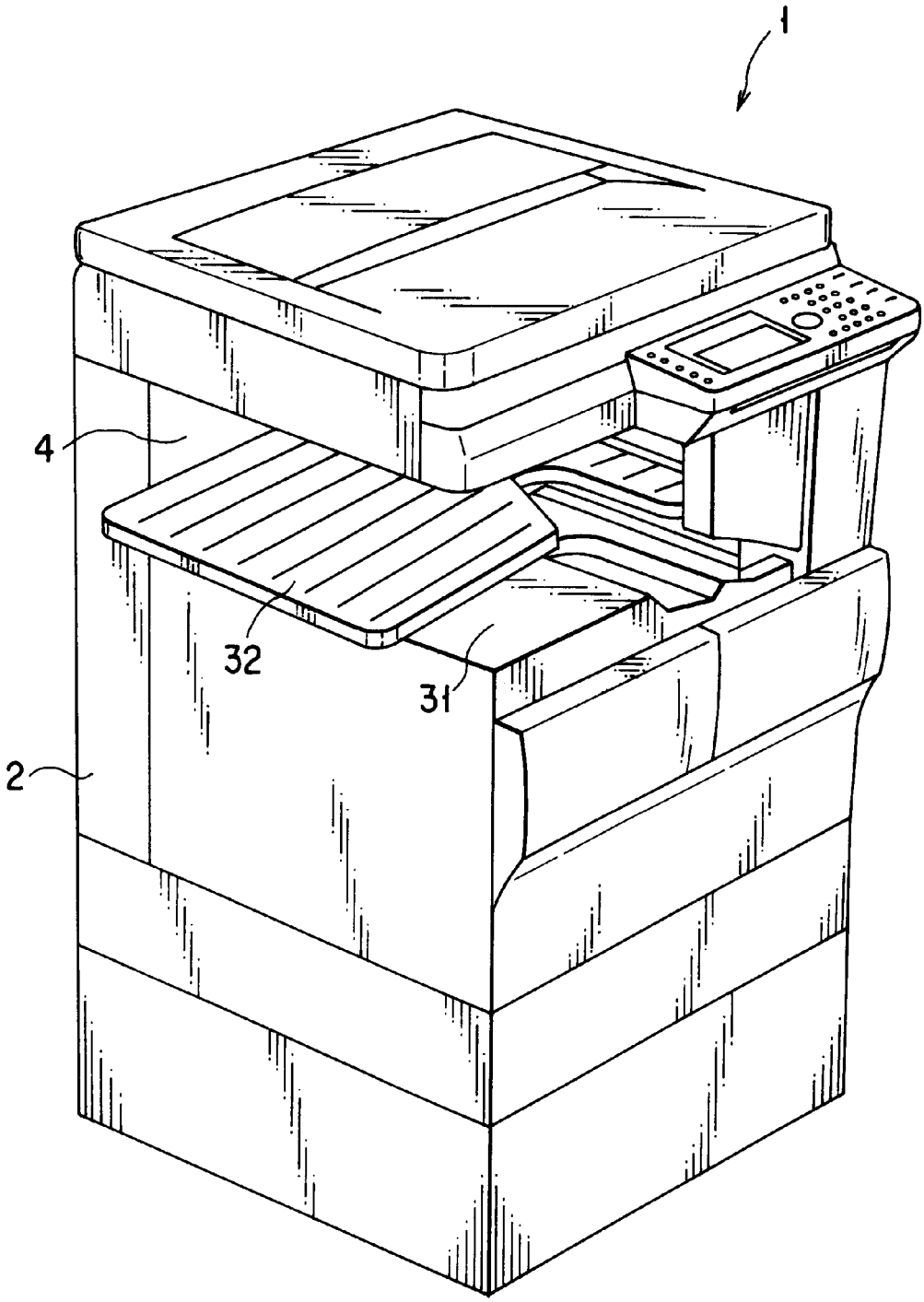
FIG. 1 is a perspective view of an image forming apparatus according to a first embodiment of the present invention.
Figure 2:
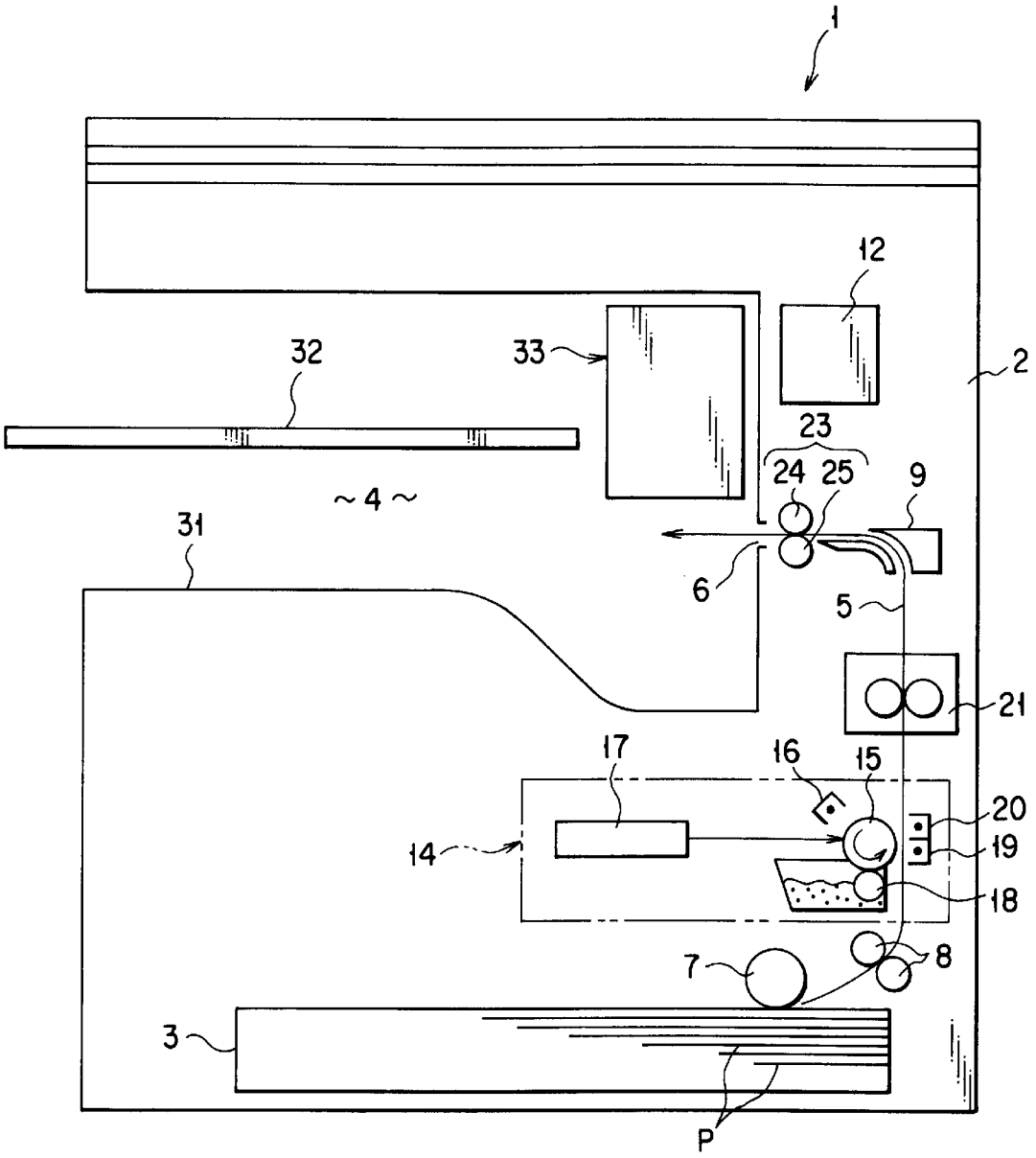
FIG. 2 is a side view of the image forming apparatus schematically showing a positional relation of an image processing mechanism, conveyance passage, upper discharge tray and lower discharge tray in the first embodiment of the present invention.

FIGS. 1 and 2 show an image forming apparatus 1 such as a copying machine. The image forming apparatus 1 has a box-shaped apparatus body 2. The apparatus body 2 has a paper feed cassette 3 and paper discharge chamber 4. The paper feed cassette 3 is disposed in a bottom part of the apparatus body 2. Recording paper P is stored in the paper feed cassette 3. The paper discharge chamber 4 is positioned in a middle part in the height direction of the apparatus body 2, and opened to the outside of the apparatus body 2.

A conveyance passage 5 is formed inside the apparatus body 2. Through the conveyance passage 5, the recording paper P is conveyed to the paper discharge chamber 4 from the paper feed cassette 3. The conveyance passage 5 extends in the height direction of the apparatus body 2. A downstream end of the conveyance passage 5 is connected to the paper discharge chamber 4 via a paper discharge port 6 formed in the apparatus body 2. The paper discharge port 6 is positioned in the middle part in the height direction of the paper discharge chamber 4. The paper discharge port 6 horizontally extends crossing at right angles to the conveyance direction of the recording paper P.

A paper feed roller 7, a plurality of conveyance rollers 8 and paper discharge guide 9 are disposed in the conveyance passage 5. The paper feed roller 7 feeds out the recording paper P stored in the paper feed cassette 3 sheet by sheet to the conveyance passage 5. The conveyance rollers 8 are positioned on the downstream side from the paper feed roller 7 along the conveyance direction of the recording paper P. The paper discharge guide 9 horizontally guides the recording paper P conveyed upwards along the conveyance passage 5. The paper discharge guide 9 is positioned in an upper end of the conveyance passage 5.

Figure 4:
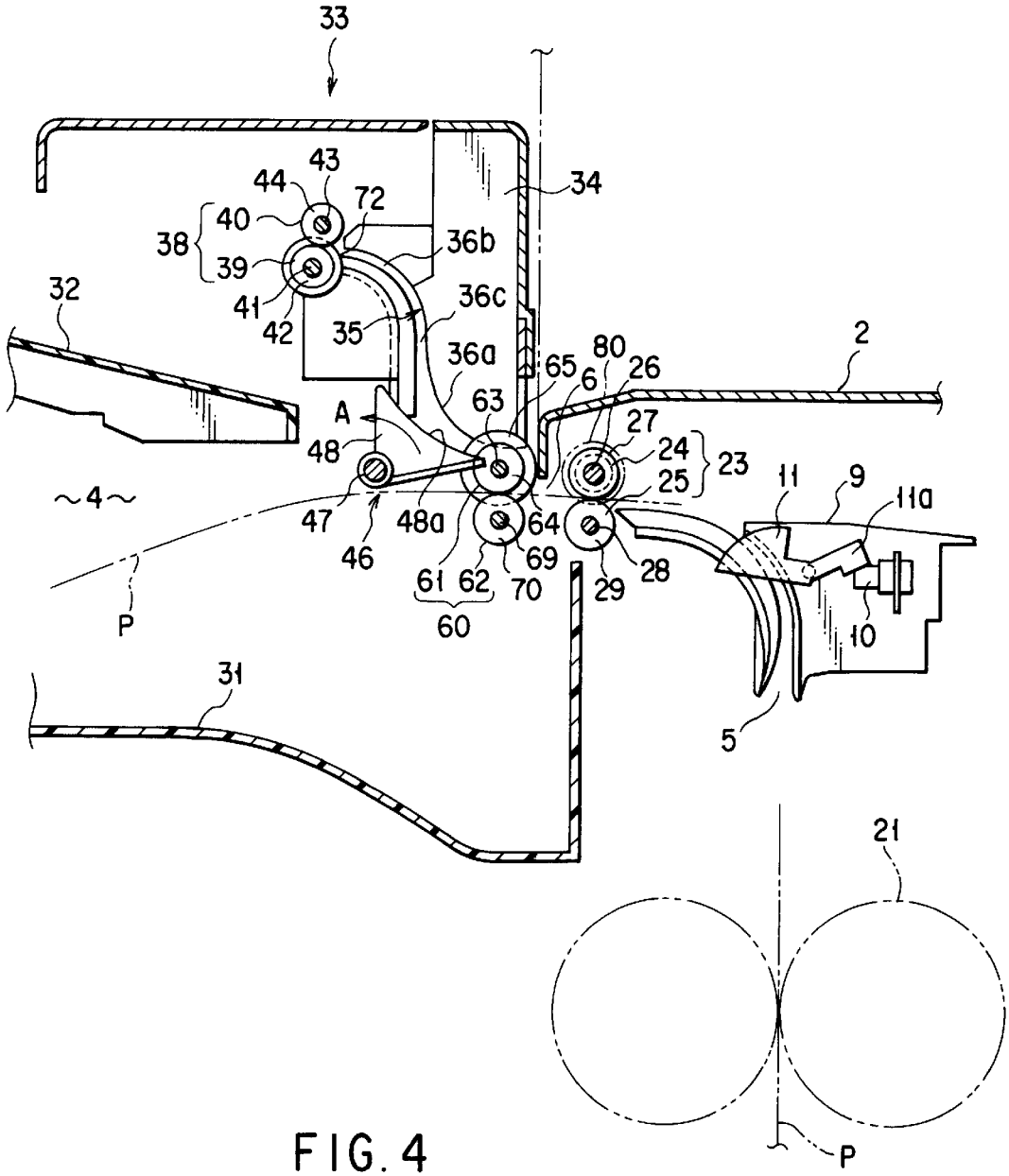
FIG. 4 is a sectional view of the image forming apparatus showing that a gate is switched to a first changeover position in the first embodiment of the present invention.

As shown in FIG. 4, a photosensor 10 and actuator 11 are attached to the paper discharge guide 9. The photosensor 10 optically detects the recording paper P conveyed to the vicinity of a downstream end of the conveyance passage 5. The photosensor 10 has a light emitting portion and light receiving portion (not shown). The actuator 11 can be rotated to a standby position to advance into the conveyance passage 5, and a detection position to retreat from the conveyance passage 5. The actuator 11 has an interceptor 11*a* which extends toward the photosensor 10. The interceptor 11*a* retreats from between the light emitting portion and the light receiving portion as long as the actuator 11 is in the standby position.

When the recording paper P conveyed through the conveyance passage 5 contacts the actuator 11 in the standby position, the actuator 11 is rotated to the detection position from the standby position. Thereby, the interceptor 11*a* advances between the light emitting portion and the light receiving portion of the photosensor 10, and intercepts light. As a result, the photosensor 10 optically detects that the recording paper P reaches the downstream end of the conveyance passage 5, and sends a control signal to a controller 12.

As shown in FIG. 2, the apparatus body 2 contains an image processing mechanism 14. The image processing mechanism 14 forms an image on the recording paper P, and is positioned midway in the conveyance passage 5. The image processing mechanism 14 includes a photosensitive drum 15, charging apparatus 16, exposing apparatus 17, developing apparatus 18, transferring apparatus 19, destaticizing apparatus 20 and fixing apparatus 21.

Figure 3:
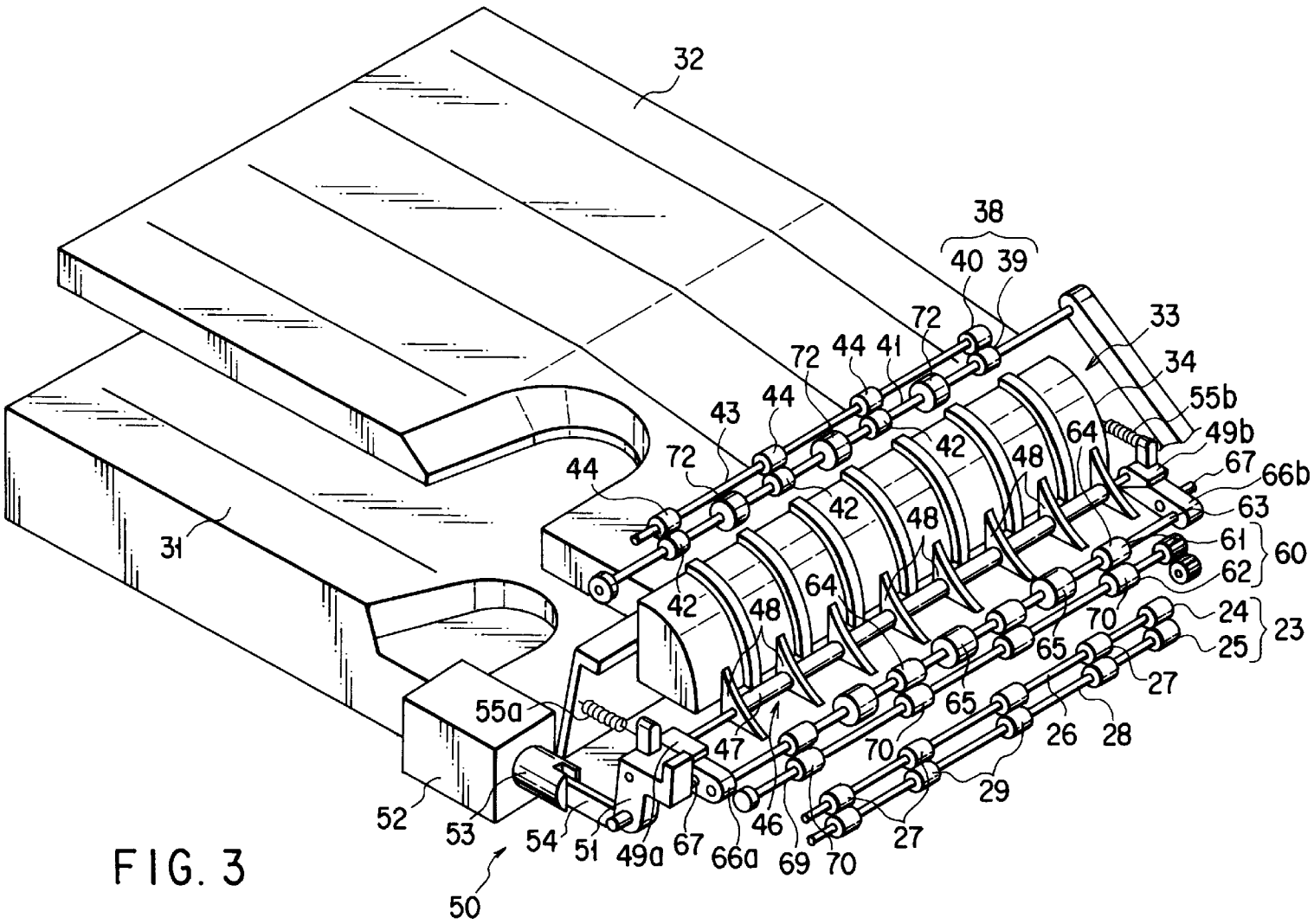
FIG. 3 is a perspective view of a separator unit according to the first embodiment of the present invention.

As shown in FIGS. 2 to 4, a roller unit 23 for discharging the sheet is disposed at the downstream end of the conveyance passage 5. The roller unit 23 feeds the recording paper P having reached the downstream end of the conveyance passage 5 out to the paper discharge port 6. The roller unit 23 includes a first roller group 24 and a second roller group 25. The first roller group 24 is constituted of a roller shaft 26 and a plurality of driving rollers 27. The roller shaft 26 is horizontally disposed along the paper discharge part 6. The roller shaft 26 is rotated by a drive source such as a motor (not shown). The driving rollers 27 are supported by the roller shaft 26. These driving rollers 27 are arranged at intervals in an axial direction of the roller shaft 26, and arranged in a row along a direction crossing at right angles to the conveyance direction of the recording paper P.

The second roller group 25 is positioned under the first roller group 24. The second roller group 25 is constituted of a roller shaft 28 and a plurality of driven rollers 29. The roller shaft 28 is horizontally disposed along the paper discharge port 6. The driven rollers 29 are supported by the roller shaft 28. These driven rollers 29 are arranged at intervals in the axial direction of the roller shaft 28, and contact the driving rollers 27 of the first roller group 24. Therefore, the first and second roller groups 24, 25 hold and convey the recording paper P therebetween.

As shown in FIGS. 2 and 4, the paper discharge chamber 4 of the apparatus body 2 includes a lower discharge tray 31 and upper discharge tray 32 as stackers. The lower discharge tray 31 is integrally formed in the bottom of the paper discharge chamber 4, and disposed in a position lower than that of the paper discharge port 6. The upper discharge tray 32 is detachably supported by the apparatus body 2. The upper discharge tray 32 is disposed above the lower discharge tray 31, and in a position higher than that of the paper discharge port 6.

Figure 5:
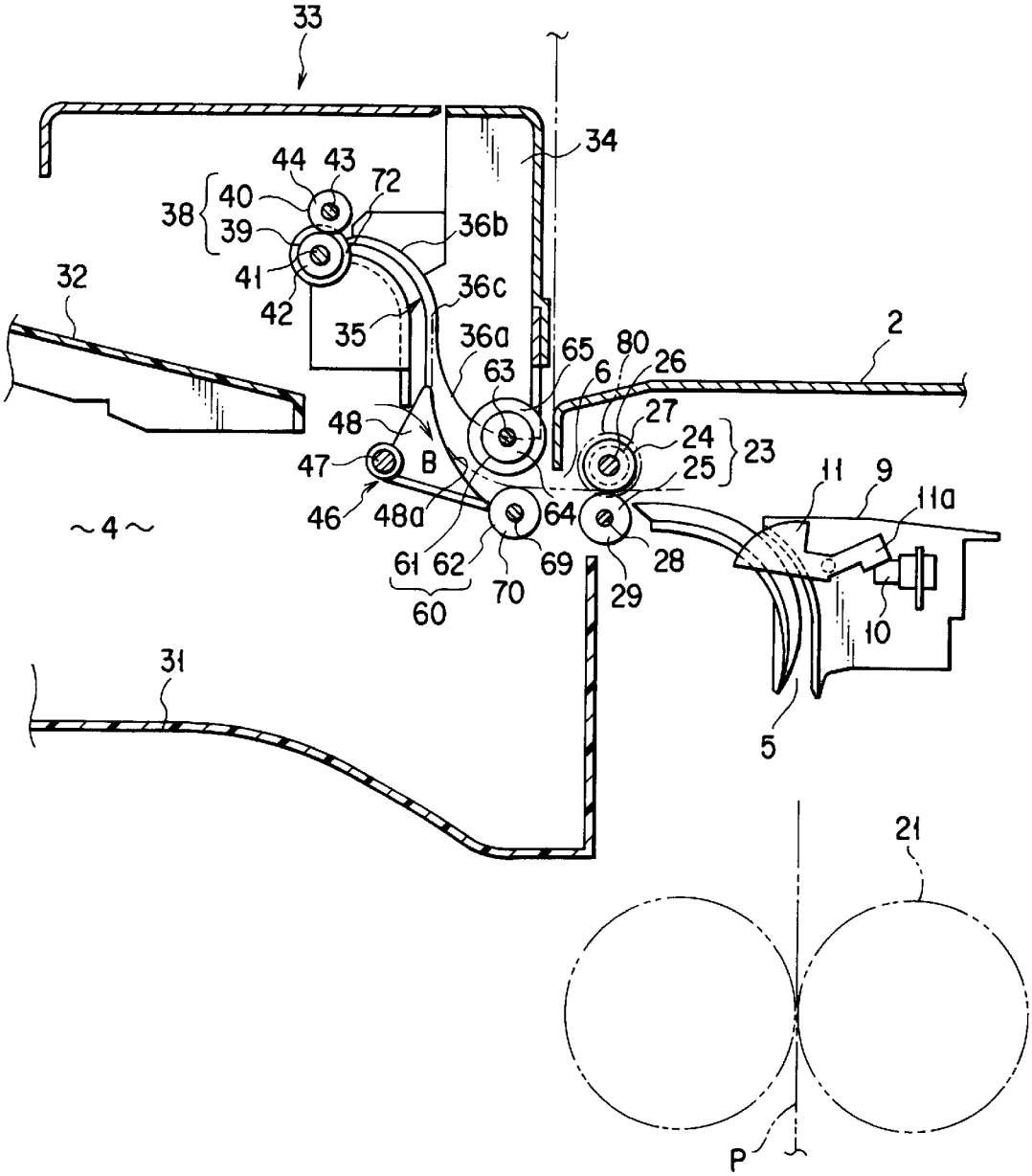
FIG. 5 is a sectional view of the image forming apparatus showing that the gate is switched to a second changeover position in the first embodiment of the present invention.

Furthermore, a separator unit 33 is disposed in the upper part of the paper discharge chamber 4. The separator unit 33 is detachably supported in the apparatus body 2, and positioned above the paper discharge port 6. As shown in FIGS. 4 and 5, the separator unit 33 includes a conveyance guide 34. The conveyance guide 34 is positioned between the upper discharge tray 32 and the paper discharge port 6. The conveyance guide 34 has a guide passage 35. The guide passage 35 guides the recording paper P discharged from the paper discharge port 6 to the upper discharge tray 32. The guide passage 35 is constituted of first and second corner portions 36*a*, 36*b* and linear portion 36*c*. The first and second corner portions 36*a*, 36*b* are curved in circular arc shapes. The first corner portion 36*a* is positioned in the upstream end of the guide passage 35, and changes the discharge direction of the recording paper P discharged from the paper discharge port 6 to an upward direction. The second corner portion 36*b* is positioned in the downstream end of the guide passage 35, and changes the conveyance direction of the recording paper P conveyed upwards to a horizontal direction. The linear portion 36*c* extends over the first and second corner portions 36*a*, 36*b* in the vertical direction. Therefore, the guide passage 35 is bent in a crank shape, and the downstream end thereof is disposed in a position higher than that of the upper discharge tray 32.

As shown in FIGS. 3 to 5, a discharge roller unit 38 is disposed in the downstream end of the guide passage 35. The discharge roller unit 38 discharges the recording paper P onto the upper discharge tray 32. The discharge roller unit 38 includes a first roller group 39 and second roller group 40. The first roller group 39 is constituted of a roller shaft 41 and a plurality of driving rollers 42. The roller shaft 41 is supported by the separator unit 33, and horizontally extends along the direction crossing at right angles to the conveyance direction of the recording paper P. The roller shaft 41 is rotated by a driving source (not shown) such as a motor. The driving rollers 42 are supported by the roller shaft 41. These driving rollers 42 are disposed at intervals in the axial direction of the roller shaft 41.

The second roller group 40 is positioned on the first roller group 39. The second roller group 40 is constituted of a roller shaft 43 and a plurality of driven rollers 44. The roller shaft 43 is disposed in parallel to the roller shaft 41. The driven rollers 44 are supported by the roller shaft 43. These driven rollers 44 are disposed at intervals in the axial direction of the roller shaft 43, and contact the driving rollers 42 of the first roller group 39. Therefore, the first and second roller groups 39, 40 hold and convey the recording paper P therebetween.

As shown in FIGS. 3 to 5, the separator unit 33 includes a changeover mechanism 46 for changing the discharge direction of the recording paper P discharged from the paper discharge port 6. The changeover mechanism 46 includes a support shaft 47 and a plurality of gates 48. The support shaft 47 is supported by the separator unit 33, and horizontally extends along the direction crossing at right angles to the conveyance direction of the recording paper P. Press levers 49*a*, 49*b* are fixed to opposite ends of the support shaft 47. The press levers 49*a*, 49*b* are disposed in parallel to each other via the support shaft 47. The gates 48 are supported by the support shaft 47, and arranged at intervals in the axial direction of the support shaft 47. These gates 48 are positioned opposite the paper discharge port 6 in the upstream end of the guide passage 35. Furthermore, the gates 48 have edges 48*a* disposed opposite the first corner portion 36*a* of the guide passage 35. The edges 48*a* are curved along the first corner portion 36*a* in the circular arc shape.

The gates 48 are rotated to either the first changeover position or the second changeover position. FIG. 4 shows that the gates 48 are rotated to the first changeover position. In the first changeover position, the gates 48 retreat in the position higher than that of the paper discharge port 6, and the edges 48*a* are detached from the paper discharge port 6. Therefore, the recording paper P discharged from the paper discharge port 6 passes under the gates 48 and drops onto the lower discharge tray 31.

FIG. 5 shows that the gates 48 are rotated to the second changeover position. In the second changeover position, the gates 48 jut out under the separator unit 33, and the edges 48*a* are disposed opposite to the paper discharge port 6. Therefore, the recording paper P discharged from the paper discharge port 6 is guided by the edges 48*a* of the gates 48 and fed into the guide passage 35 of the separator unit 33.

As well shown in FIG. 3, the separator unit 33 includes a driving device 50. The driving device 50 moves the gates 48 to the second changeover position from the first changeover position or in reverse. The driving device 50 includes an L-shaped link 51 and solenoid 52.

The L-shaped link 51 has a middle portion as a fulcrum, and the middle portion is connected to one end of the support shaft 47. The solenoid 52 includes a plunger 53 which operates linearly. The plunger 53 is connected to the L-shaped link 51 via an arm 54. A connected portion of the L-shaped link 51 and arm 54 is positioned under the support shaft 47. The L-shaped link 51 is biased in a counterclockwise direction in FIG. 3 via a pair of return springs 55*a*, 55*b*. One return spring 55*a* extends between the L-shaped link 51 and the separator unit 33. The other return spring 55*b* extends between the press lever 49*b* and the separator unit 33.

When the solenoid 52 is turned OFF, the plunger 53 projects. At this time, the L-shaped link 51 is pulled in the counterclockwise direction centering on the support shaft 47 by the return spring 55*a*. Therefore, the support shaft 47 is rotated in the counterclockwise direction, and the gates 48 are moved to the first changeover position as shown by an arrow A of FIG. 4.

When the solenoid 52 is turned ON, the plunger 53 is retired. Thereby, one end of the L-shaped link 51 is pulled in a clockwise direction against the spring force of the return spring 55*a*. Then, the support shaft 47 rotates in the clockwise direction, and the gates 48 are moved to the second changeover position from the first changeover position, as shown by arrow B in FIG. 5.

As shown in FIGS. 3 to 5, the separator unit 33 includes a press mechanism 60. The press mechanism 60 waves the recording paper P discharged from the paper discharge port 6, and temporarily makes the recording paper P rigid. The press mechanism 60 is positioned between the gates 48 and the paper discharge port 6.

The press mechanism 60 includes a first roller group 61 and second roller group 62. The first roller group 61 includes a roller shaft 63, a plurality of driven rollers 64 and a plurality of press rollers 65. The roller shaft 63 is horizontally disposed along the direction crossing at right angles to the conveyance direction of the recording paper P. The roller shaft 63 is supported by the separator unit 33 via a pair of links 66*a*, 66*b*. The links 66*a*, 66*b* are attached to opposite ends of the roller shaft 63. These links 66*a*, 66*b* have respective pivot shafts 67 apart from the roller shaft 63. The pivot shafts 67 are rotatably supported by the separator unit 33. Therefore, the links 66*a*, 66*b* can rotate centering on the pivot shafts 67, and are constantly biased downwards via springs (not shown). The driven rollers 64 are supported by the roller shaft 63, and disposed at intervals in the axial direction of the roller shaft 63. The press rollers 65 are supported by the roller shaft 63, and positioned between the driven rollers 64 disposed adjacent to each other. Therefore, the driven rollers 64 and press rollers 65 are alternately arranged in the direction crossing at right angles to the conveyance direction of the recording paper P.

Furthermore, the press rollers 65 have diameters larger than those of the driven rollers 64. Therefore, the outer peripheral surfaces of the press rollers 65 extends outwards from the outer peripheral surfaces of the driven rollers 64.

The second roller group 62 is positioned under the first roller group 61. The second roller group 62 includes a roller shaft 69, and a plurality of driving rollers 70. The roller shaft 69 is supported by the separator unit 33, and disposed in parallel to the roller shaft 63 of the first roller group 61. The roller shaft 69 receives the power from a motor (not shown) and rotates. The driving rollers 70 are supported by the roller shaft 69. These driving rollers 70 are disposed at intervals in the axial direction of the roller shaft 69, and contact the driven rollers 64 of the first roller group 61 from below. Therefore, when the driving rollers 70 rotate, the driven rollers 64 and press rollers 65 rotate accordingly. As a result, the recording paper P discharged from the paper discharge port 6 is guided between the driving rollers 70 and the driven rollers 64, held between the rollers 70 and 64, and fed into the paper discharge chamber 4.

The outer peripheral surfaces of the press rollers 65 jut out downwards from the contact portions of the driven rollers 64 and driving rollers 70. Therefore, the press rollers 65 are pressed onto a plurality of portions of the recording paper P. Thereby, a downward pressure is applied to the recording paper P, and a wavy shape is given to the recording paper P.

As shown in FIG. 3, the links 66*a*, 66*b* supporting the roller shaft 63 are positioned under the press levers 49*a*, 49*b*. The ends of the links 66*a*, 66*b* opposite the roller shaft 63 are constantly pressed onto the press levers 49*a*, 49*b* by spring forces of the springs. When the gates 48 rotate toward the first changeover position shown in FIG. 4, the press levers 49*a*, 49*b* rotate in the counterclockwise direction of FIG. 3 via the support shaft 47. By the rotation, the contact portions of the press levers 49*a*, 49*b* and links 66*a*, 66*b* are moved to positions higher than the positions of the pivot shafts 67, and the links 66*a*, 66*b* rotate in the clockwise direction. As a result, the first roller group 61 moves to a press position in which the press rollers 65 are pressed onto the recording paper P. Therefore, as long as the gates 48 are in the first changeover position, the press rollers 65 wave the recording paper P discharged from the paper discharge port 6.

When the gates 48 rotate toward the second changeover position shown in FIG. 5, the press levers 49*a*, 49*b* rotate in the clockwise direction of FIG. 3 via the support shaft 47. By the rotation, the contact portions of the press levers 49*a*, 49*b* and links 66*a*, 66*b* move to the positions lower than the positions of the pivot shafts 67, and the links 66*a*, 66*b* rotate in the counterclockwise direction. As a result, the first roller group 61 moves to a press release position in which the press rollers 65 are detached from the recording paper P. Therefore, as long as the gates 48 are in the second changeover position, the press rollers 65 are not pressed onto the recording paper P.

Therefore, the press rollers 65 follow the movement of the gates 48 and are moved to either the press position or the press release position. In the present embodiment, the press levers 49*a*, 49*b* and links 66*a*, 66*b* constitute cooperation means for transmitting the movement of the gates 48 to the press rollers 65.

As shown in FIGS. 3 to 6, the first roller group 39 of the discharge roller unit 38 has a plurality of press rollers 72 as another press mechanism. The press rollers 72 are positioned in the downstream end of the guide passage 35. These press rollers 72 are supported by the roller shaft 41, and positioned between the driving rollers 42 disposed adjacent to each other. Therefore, the driving rollers 42 and press rollers 72 are alternately arranged in the direction crossing at right angles to the conveyance direction of the recording paper P.

Furthermore, the press rollers 72 have diameters larger than those of the driving rollers 42. The outer peripheral surfaces of the press rollers 72 jut out from the outer peripheral surfaces of the driving rollers 42. Therefore, when the recording paper P is discharged onto the upper discharge tray 32 from the guide passage 35, the press rollers 72 are pressed onto the plurality of portions of the recording paper P from below. Thereby, an upward pressure is applied to the recording paper P, and a wavy shape is given to the recording paper P.

The press mechanism 60 is attached to the separator unit 33. Therefore, when the separator unit 33 is detached from the apparatus body 2, the recording paper P discharged from the paper discharge port 6 cannot be waved. As a countermeasure, in the image forming apparatus 1 of the present embodiment, a mechanism for waving the recording paper P is added to the roller unit 23 positioned in the downstream end of the conveyance passage 5.

FIGS. 6 to 12 show details of the first roller group 24 of the roller unit 23. Of the driving rollers 27 of the first roller group 24, some specified ones have portion 76 that extends in the axial direction. The extended portions 76 are disconnected from the driven rollers 29, and disposed opposite to the roller shaft 28 which supports the driven rollers 29.

First attachment grooves 77 and a second attachment grooves 78 are formed in the outer peripheral surfaces of the driving rollers 27. The first and second attachment grooves 77, 78 are continuous in a peripheral direction of the driving rollers 27, and are disposed apart from each other in the axial direction of the driving rollers 27. The first attachment grooves 77 are positioned in the extended portions 76 of the driving rollers 27. Depth dimensions D1 of the first attachment grooves 77 are smaller than depth dimensions D2 of the second attachment grooves 78. O rings 80 as press members are attached to the first attachment groove 77 or second attachment groove 78. The O rings 80 are constituted of elastically deformable rubber materials. When the O rings 80 are in a free state, inner diameters of the O rings 80 are substantially equal to the diameters of the bottom portions of the second attachment grooves 78. Furthermore, linear diameters d of the O rings 80 are larger than the depth dimensions D1 of the first attachment grooves 77, and smaller than the depth dimensions D2 of the second attachment grooves 78.

Figure 6:
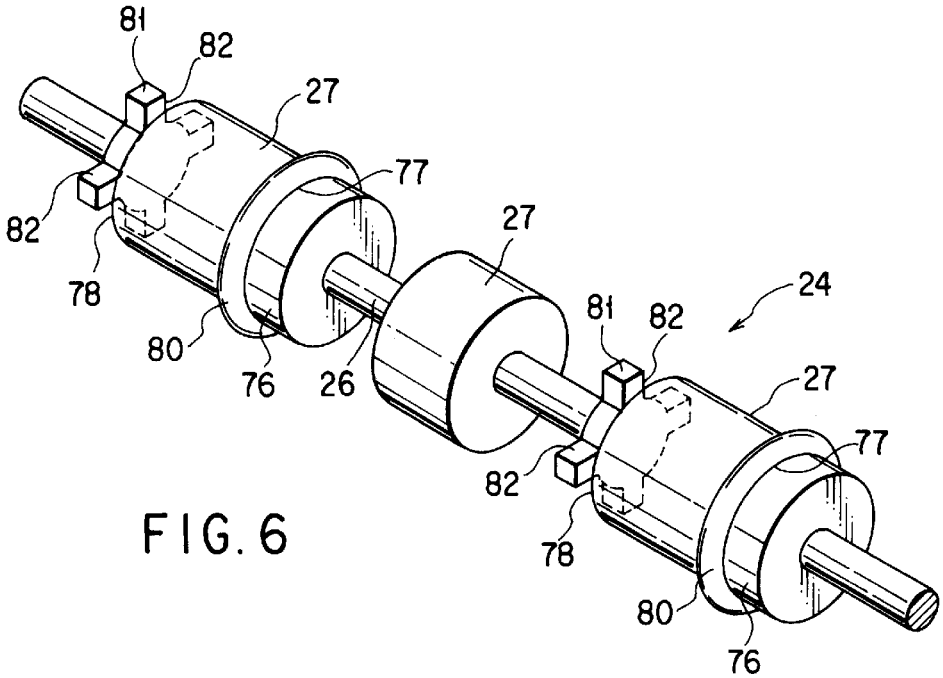
FIG. 6 is a perspective view of a first roller group in a state in which an O ring is attached to a first attachment groove in the first embodiment of the present invention.
Figure 8:
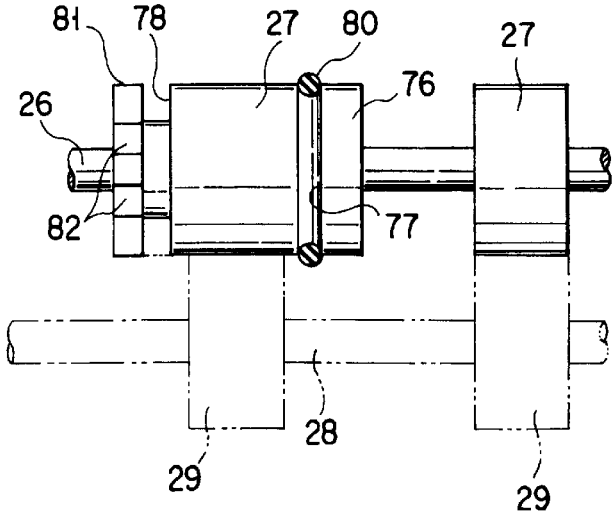
FIG. 8 is a side view of the driving roller in the state in which the O ring is attached to the first attachment groove in the first embodiment of the present invention.

The O rings 80 can selectively moved over a first position in which the rings are attached to the first attachment grooves 77, and a second position in which the rings are attached to the second attachment grooves 78. FIGS. 6 and 8 show that the O rings 80 are attached to the first attachment grooves 77. In the first position, the O rings 80 jut out from the outer peripheral surfaces of the driving rollers 27. Therefore, when the recording paper P passes between the driving rollers 27 and the driven rollers 29, the O rings 80 are pressed onto the plurality of portions of the recording paper P from above. Thereby, a downward pressure is applied to the recording paper P, and the wavy shape is given to the recording paper P.

Figure 7:
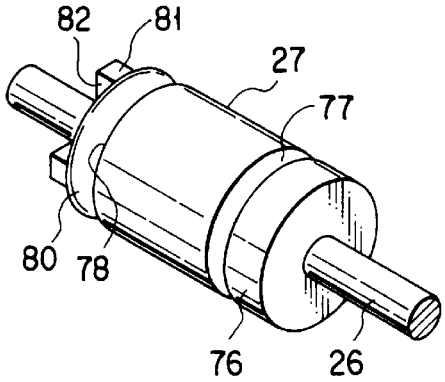
FIG. 7 is a perspective view of a driving roller in a state in which the O ring is attached to a second attachment groove in the first embodiment of the present invention.
Figure 9:
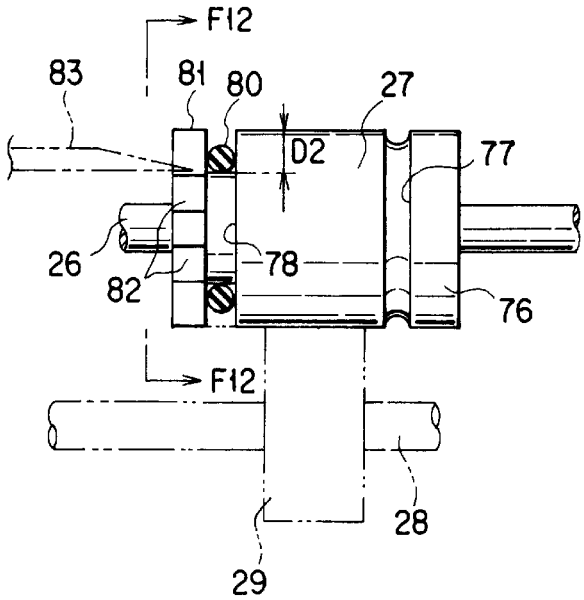
FIG. 9 is a side view of the driving roller in the state in which the O ring is attached to the second attachment groove in the first embodiment of the present invention.
Figure 10:
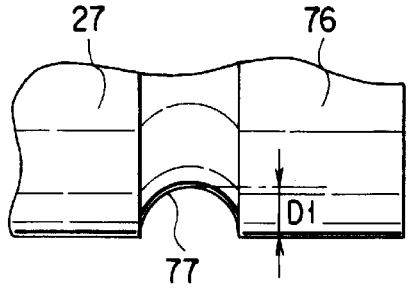
FIG. 10 is a side view of the driving roller showing the first attachment groove in an enlarged manner according to the first embodiment of the present invention.
Figure 11:
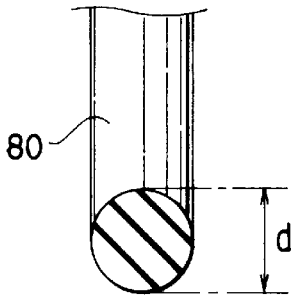
FIG. 11 is a sectional view of the O ring for use in the first embodiment of the present invention.

FIGS. 7 and 9 show that the O rings 80 are attached to the second attachment grooves 78. In the second position, the O rings 80 completely fit in the second attachment grooves 78, and retreat from the outer peripheral surfaces of the driving rollers 27. Therefore, when the recording paper P passes between the driving rollers 27 and the driven rollers 29, the O rings 80 do not contact the recording paper P. Therefore, the recording paper P is discharged from the paper discharge port 6 without being waved.

Figure 12:
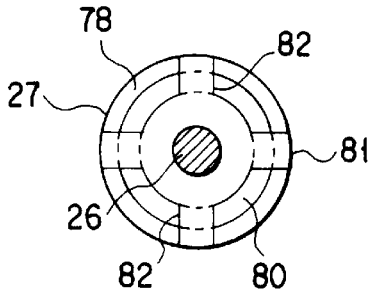
FIG. 12 is a sectional view taken along line F12—F12 of FIG. 9.

The driving rollers 27 include ends 81 disposed on an opposite side of the extended portions 76. This ends 81 have a plurality of cutouts 82. The cutouts 82 are disposed at intervals in a peripheral direction of the driving roller 27. The cutouts 82 are opened in the outer peripheral surfaces of the ends 81 of the driving rollers 27, the end surfaces of the ends 81 and second attachment grooves 78. As shown in FIG. 12, when the O rings 80 are attached to the second attachment grooves 78, the O rings 80 are exposed in the direction of the end surfaces of the ends 81 through the cutouts 82.

Therefore, as shown in FIG. 9, when a tool 83 such as a driver is inserted into the cutouts 82 from the end surface of the end 81, the tool 83 can be caught by the O ring 80 in the second attachment groove 78. Therefore, even when the O rings 80 completely fit in the second attachment grooves 78, the O rings 80 can easily be removed from the second attachment grooves 78.

According to the constitution of the driving rollers 27, when the O rings 80 are attached to either the first attachment grooves 77 or the second attachment grooves 78, it can easily be selected whether or not to give the wavy shape to the recording paper P. Therefore, even when the separator unit 33 having the press mechanism 60 is detached from the apparatus body 2, the driving rollers 27 of the roller unit 23 can be used to give the wavy shape to the recording paper P. As a result, the recording paper P dropping onto the lower discharge tray 31 from the paper discharge port 6 temporarily becomes rigid, and the recording paper P is stacked onto the lower discharge tray 31 in an orderly aligned state.

An operation of the image forming apparatus 1 with the separator unit 33 attached to the paper discharge chamber 4 of the apparatus body 2 will next be described. When the recording paper P with the image formed thereon is guided to the upper discharge tray 32, the recording paper P is guided into the guide passage 35 without being pressed by the press rollers 65. When the recording paper P with the image formed thereon is guided onto the lower discharge tray 31, the recording paper P is pressed by the press rollers 65.

Figure 13:
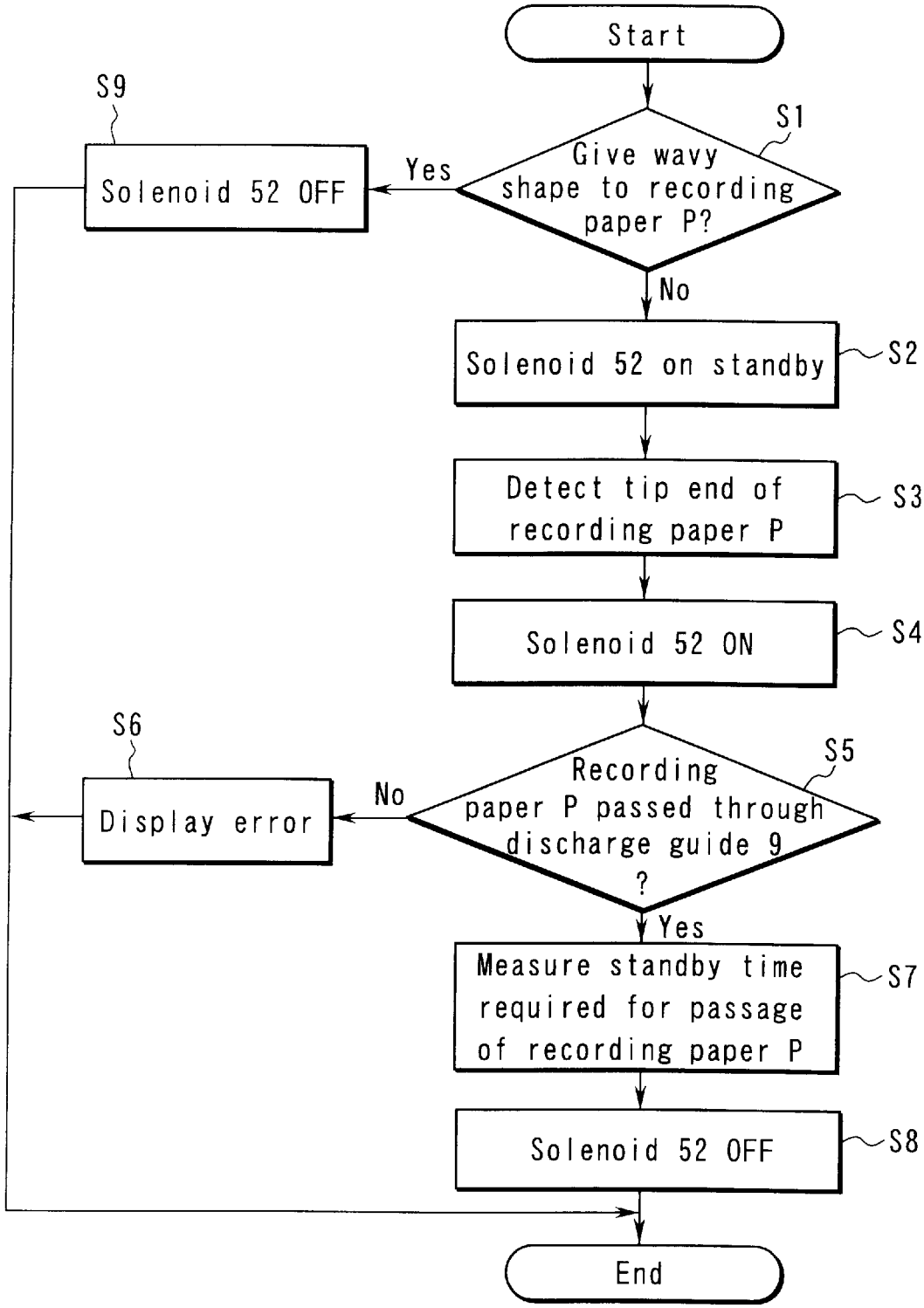
FIG. 13 is a flowchart of a process for giving a wavy shape to a recording sheet in the first embodiment of the present invention.

A procedure for pressing or not pressing the recording paper P will be described with reference to a flowchart shown in FIG. 13.

First it is selected in step S1 whether or not to give the wavy shape to the recording paper P. When the recording paper P is guided onto the upper discharge tray 32, the recording paper P does not have to be waved, and therefore the procedure shifts to step S2. In the step S2, the solenoid 52 is on standby by a command from the controller 12.

In the next step S3, the recording paper P conveyed through the conveyance passage 5 is detected. When the tip end of the recording paper P contacts the actuator 11 of the paper discharge guide 9, the actuator 11 rotates to the detection position from the standby position. By the rotation, the photosensor 10 optically detects that the recording paper P reaches the downstream end of the conveyance passage 5, and sends the control signal to the controller 12.

In the next step S4, the solenoid 52 is turned ON by the command from the controller 12. Thereby, the plunger 53 of the solenoid 52 is retired, and the L-shaped link 51 rotates against the spring force of the return spring 55*a* in the clockwise direction. As a result, the gates 48 are moved to the second changeover position from the first changeover position. The movement of the gates 48 is transmitted to the first roller group 61 of the press mechanism 60 via the press levers 49*a*, 49*b* and links 66*a*, 66*b*. Therefore, the first roller group 61 moves to the press release position, and the press rollers 65 and driven rollers 64 are detached from the driving rollers 70.

As a result, as shown in FIG. 5, the tip end of the recording paper P discharged from the paper discharge port 6 passes between the first roller group 61 and the second roller group 62, and the press rollers 65 and driven rollers 64 do not contact the recording paper P. Therefore, the recording paper P is not given the wavy shape.

In the next step S5, it is detected whether or not the rear end of the recording paper P conveyed through the conveyance passage 5 passes through the paper discharge guide 9. When the recording paper P passes through the paper discharge guide 9, the actuator 11 returns to the standby position from the detection position. Therefore, the photosensor 10 sends the control signal indicating the passage of the recording paper P to the controller 12. When the actuator 11 is held in the detection position, the controller 12 judges that there is a problem in the conveyance of the recording paper P, and the procedure advances to step S6. In the step S6, an error is displayed in a display (not shown) of the image forming apparatus 1, indicating that the problem has arisen in the conveyance of the recording paper P.

When the passage of the recording paper P through the paper discharge guide 9 is detected in the step S5, the procedure advances to step S7. In the step S7, the controller 12 counts constant pulses. Thereby, a required standby time is measured from when the rear end of the recording paper P passes through the paper discharge guide 9 until the paper passes through the discharge roller unit 38.

In the next step S8, the solenoid 52 is turned OFF by the command from the controller 12. Therefore, the gates 48 are moved to the first changeover position from the second changeover position, and the first roller group 61 of the press mechanism 60 follows the movement of the gates 48 and moves to the press position from the press release position. Thereby, the conveyance of one recording sheet P is completed.

In the step S4, as shown in FIG. 5, the recording paper P passed between the first roller group 61 and the second roller group 62 is guided by the edges 48*a* of the gates 48, and the conveyance direction is changed to the upward direction from the horizontal direction. Furthermore, the recording paper P is conveyed to the second corner portion 36*b* through the linear portion 36*c* from the first corner portion 36*a* of the conveyance passage 35. Therefore, when the recording paper P is passed through the conveyance passage 5, the conveyance direction is again changed to the horizontal direction from the upward direction.

The recording paper P having reached the downstream end of the guide passage 35 is discharged onto the upper discharge tray 31 by the discharge roller unit 38. The first roller group 39 of the discharge roller unit 38 has a plurality of press rollers 72. Therefore, when the recording paper P reaches the downstream end of the guide passage 35, the press rollers 72 are pressed onto the plurality of portions of the recording paper P from below. Thereby, the upward pressure is applied to the recording paper P, and the wavy shape is given to the recording paper P. Therefore, the recording paper P temporarily becomes rigid, and is stacked onto the upper discharge tray 32 in the orderly aligned state.

When the recording paper P is guided onto the lower discharge tray 31, the recording paper P needs to be waved, and therefore the procedure shifts to step S9 from the step S1. In the step S9, the solenoid 52 is kept OFF. Therefore, as shown in FIG. 4, the gates 48 are held in the first changeover position, and the first roller group 61 of the press mechanism 60 is held in the press position. As a result, the press rollers 65 are pressed onto the plurality of portions of the recording paper P discharged from the paper discharge port 6 from above. Thereby, the downward pressure is applied to the recording paper P, and the wavy shape is given to the recording paper P. Therefore, the recording paper P temporarily becomes rigid, and is stacked onto the lower discharge tray 31 in the orderly aligned state.

According to the image forming apparatus 1, when the recording paper P is guided into the guide passage 35 bent in the crank shape, the first roller group 61 of the press mechanism 60 is held in the press release position.

Therefore, the recording paper P is not waved. When the recording paper P passes through the guide passage 35, an unnecessary force is not applied to the recording paper P. Therefore, the recording paper P can be prevented from abnormally sounding as if something were broken.

Furthermore, since the recording paper P is smoothly conveyed in the guide passage 35, the recording paper P is not wrinkled, and jamming does not occur.

FIGS. 14 to 17 show a second embodiment of the present invention. The second embodiment is different from the first embodiment in a constitution of a press mechanism 90 for giving the wavy shape to the recording paper P. The basic constitution of the image forming apparatus 1 excluding the press mechanism 90 is similar to that of the first embodiment. Therefore, in the second embodiment, the same constituting components as those of the first embodiment are denoted with the same reference numerals, and the description thereof is omitted.

Figure 14:
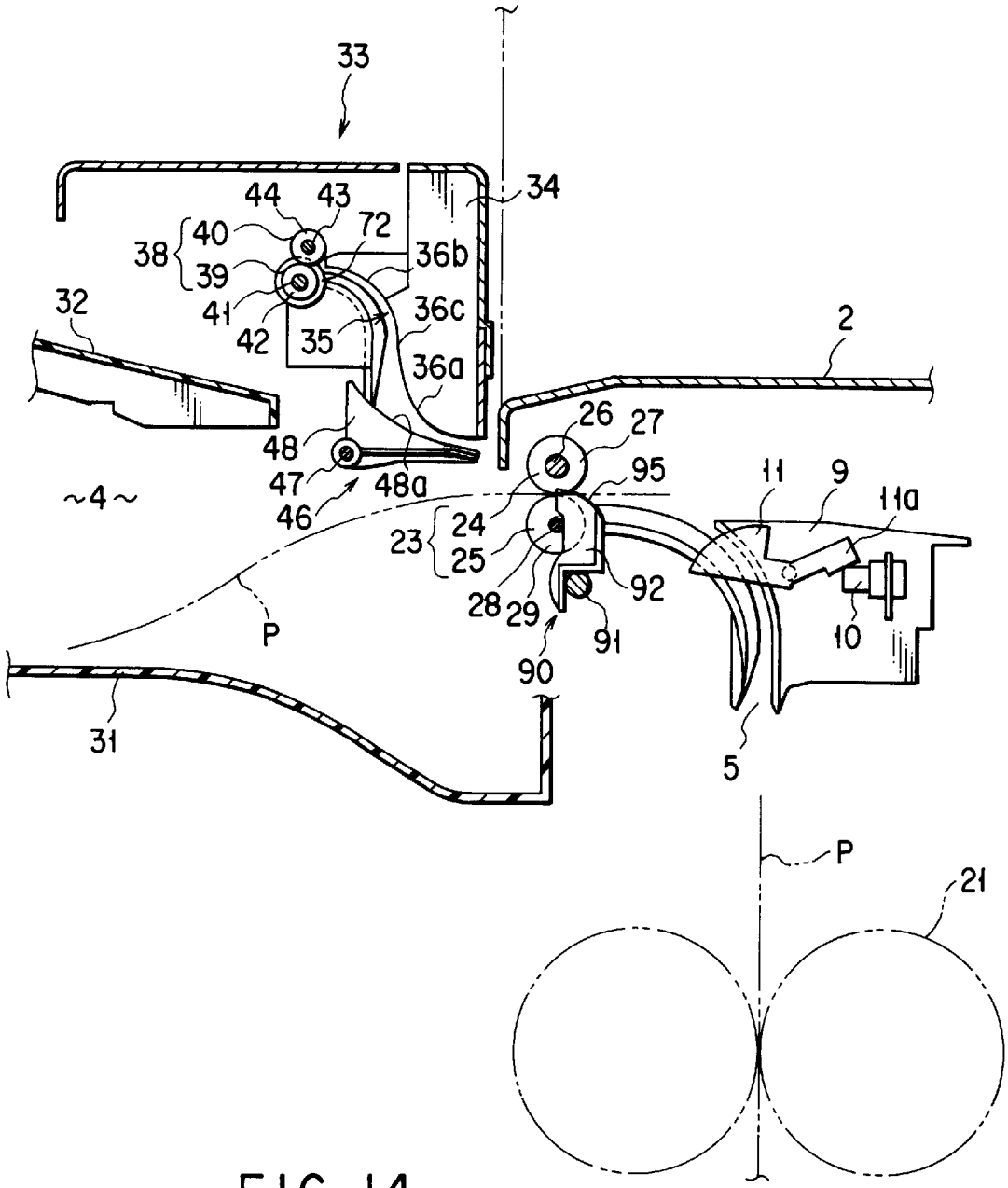
FIG. 14 is a sectional view of the image forming apparatus showing that the gate is switched to the first changeover position in a second embodiment of the present invention.
Figure 15:
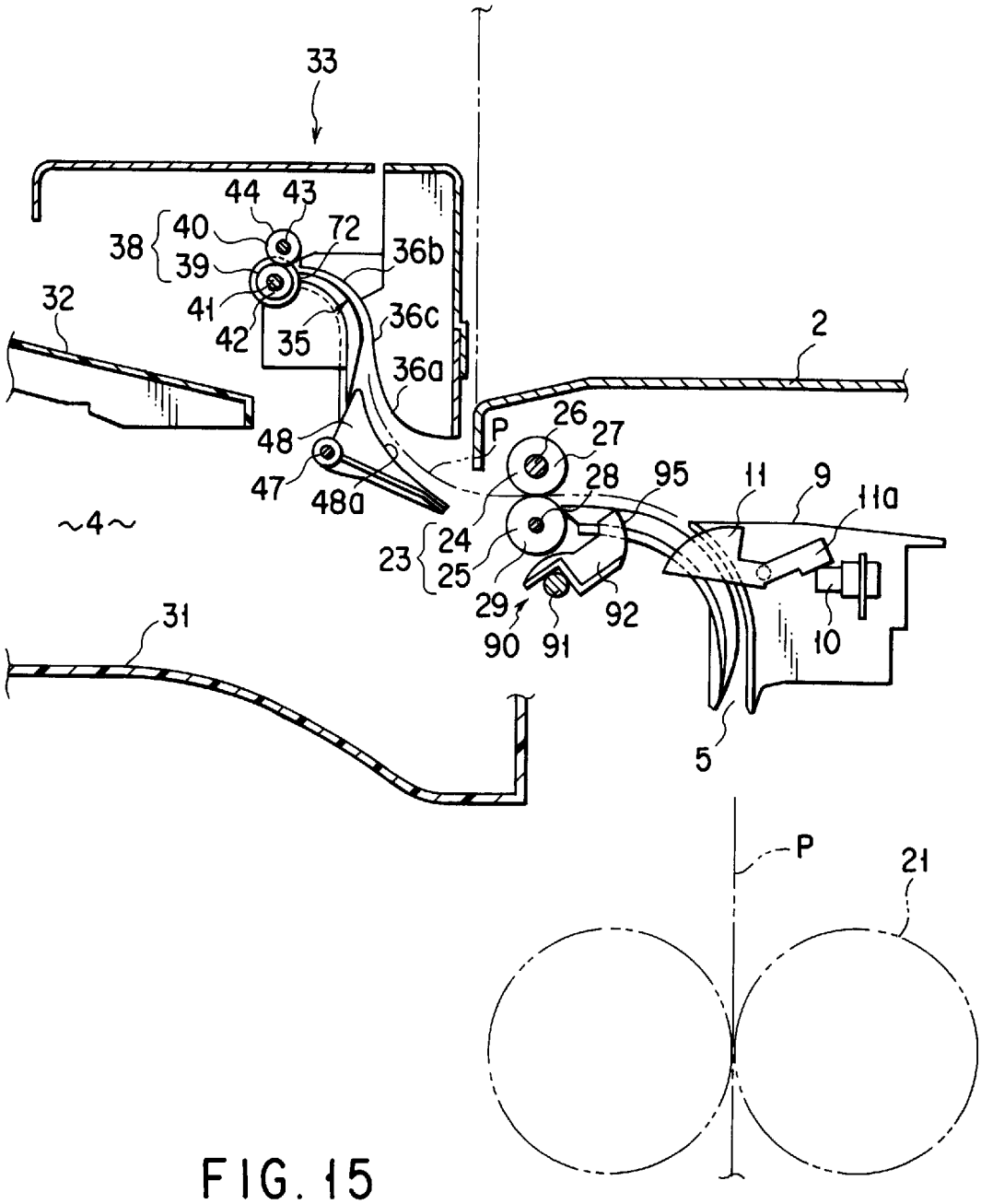
FIG. 15 is a sectional view of the image forming apparatus showing that the gate is switched to the second changeover position in the second embodiment of the present invention.
Figure 16:
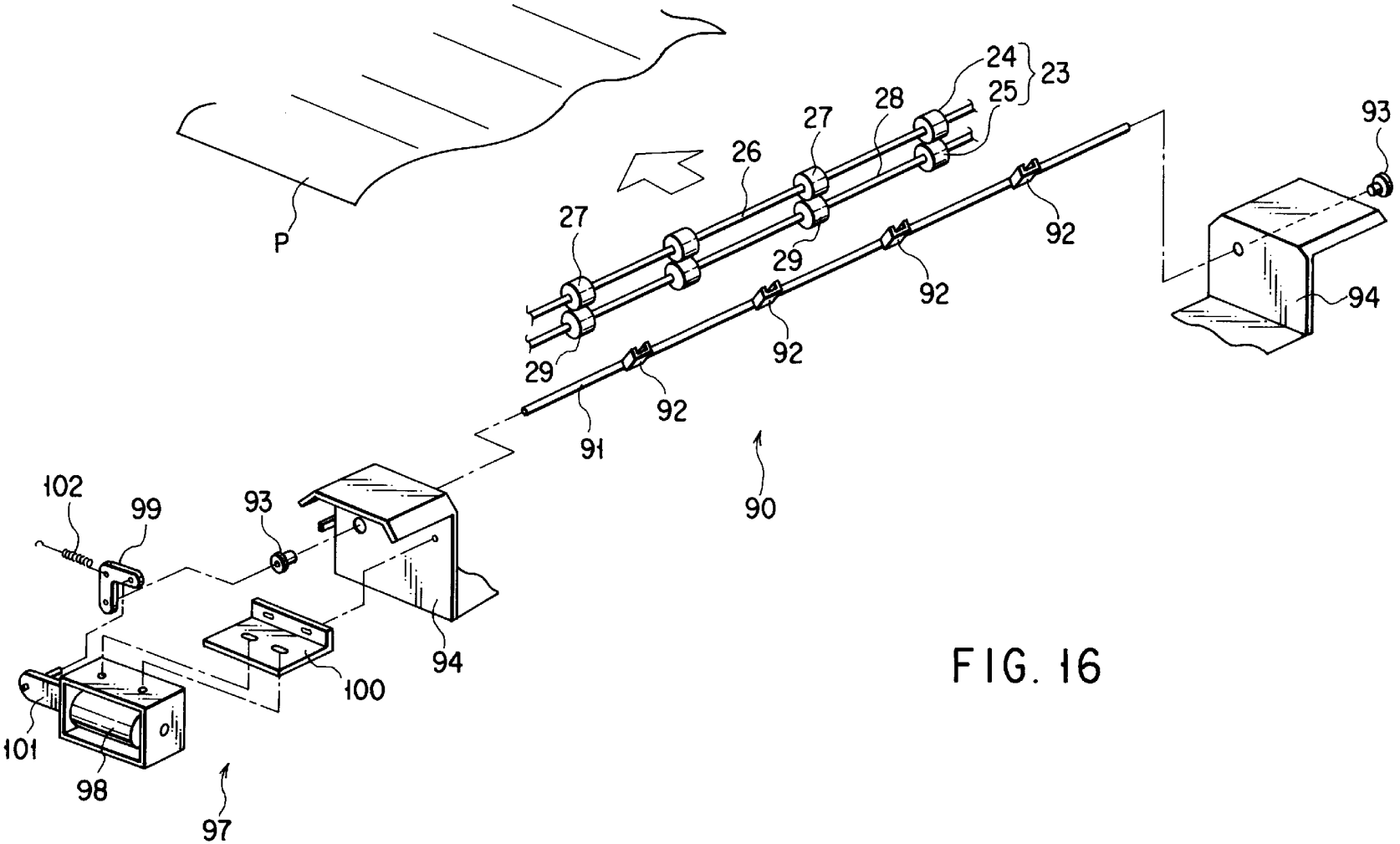
FIG. 16 is a perspective view showing a position relation between a roller unit and a pressing mechanism in the second embodiment of the present invention.

As shown in FIGS. 14 to 16, the press mechanism 90 is supported by the apparatus body 2. The press mechanism 90 is positioned in the downstream end of the conveyance passage 5, and disposed adjacent to the discharging roller unit 23. The press mechanism 90 has a guide shaft 91 and a plurality of press members 92. The guide shaft 91 is positioned under the second roller group 25 of the roller unit 23, and disposed in parallel to the roller shaft 28 of the second roller group 25. The opposite ends of the roller shaft 91 are supported by frames 94 via bearings 93, respectively. The frames 94 are fixed to the apparatus body 2.

The press members 92 are fixed to the guide shaft 91, and arranged at intervals in the axial direction of the guide shaft 91. These press members 92 are positioned between the driven rollers 29 on the roller shaft 28. As shown in FIGS. 14 and 15, the press members 92 project along the diametric direction of the guide shaft 91, and have press surfaces 95 on the projecting tip end thereof. The press surfaces 95 are curved in the circular arc shapes.

The press members 92 can rotate over the press release position and press position. FIG. 15 shows that the press members 92 are rotated to the press release position. In the press release position, the press members 92 are inclined toward the upstream side along the conveyance direction of the recording paper P with respect to the second roller group 25. Therefore, the press surfaces 95 of the press members 92 retreat below the conveyance passage 5.

FIG. 14 shows that the press members 92 are rotated to the press position. In the press position, the press members 92 are allowed to rise just before the driven rollers 29, and the press surfaces 95 of the press members 92 jut out in the conveyance passage 5. The press surfaces 95 deviate toward the upstream side along the conveyance direction of the recording paper P from the contact portions of the driven rollers 29 and recording paper P. Therefore, the press surfaces 95 are pressed onto the recording paper P from below before the recording paper P is guided between the driving rollers 27 and the driven rollers 29. Thereby, the upward pressure is applied to the recording paper P, and the wavy shape is given to the recording paper P.

As shown in FIG. 16, the press mechanism 90 includes a driving device 97. The driving device 97 moves the press members 92 to the press position from the position release position or in reverse. The driving device 97 includes a solenoid 98 and L-shaped link 99. The solenoid 98 is supported by the frame 94 via a bracket 100. The solenoid 98 includes a plunger 101 which operates linearly. The plunger 101 is connected to one end of the L-shaped link 99. The other end of the L-shaped link 99 is connected to one end of the guide shaft 91. Therefore, the L-shaped link 99 rotates centering on the other end. Furthermore, the L-shaped link 99 is biased in the counterclockwise direction of FIG. 16 via a return spring 102.

When the solenoid 98 is OFF, the plunger 101 projects. At this time, the L-shaped link 99 is pulled in the counterclockwise direction centering on the guide shaft 91 via the return spring 102. Therefore, the guide shaft 91 rotates in the counterclockwise direction, and the press members 92 are held in the press position as shown in FIG. 14.

When the solenoid 98 is ON, the plunger 101 is retired. Thereby, the L-shaped link 99 is pulled in the clockwise direction against the spring force of the return spring 102. Then, the guide shaft 91 rotates in the clockwise direction, and the press members 92 are moved to the press release position from the press position as shown in FIG. 15.

Figure 17:
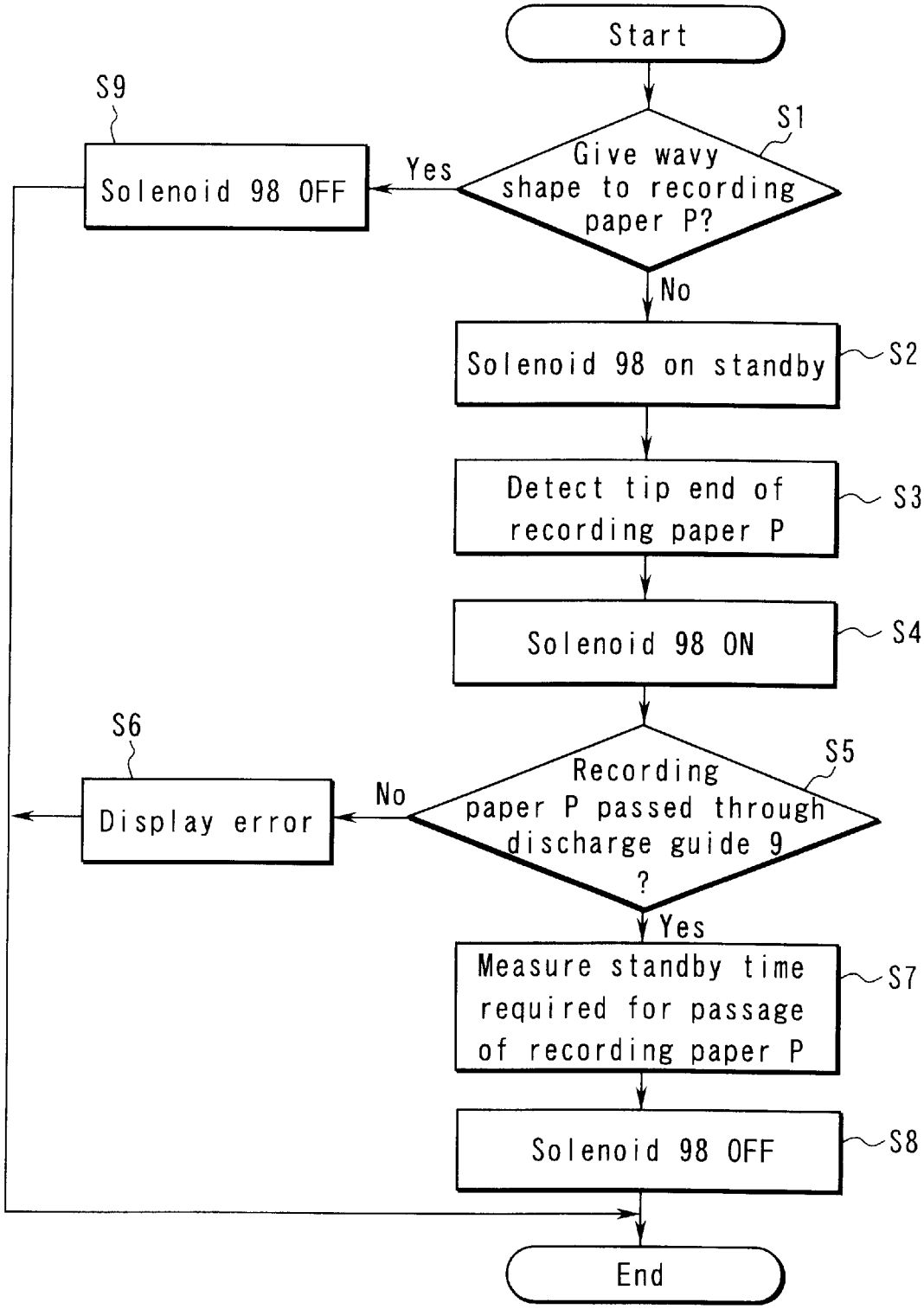
FIG. 17 is a flowchart showing a process for giving the wavy shape to the recording sheet in the second embodiment of the present invention.

FIG. 17 is a flowchart showing a procedure for waving the recording paper P and discharging the paper from the paper discharge port 6, or discharging the recording paper P from the paper discharge port 6 without waving the paper. As shown in FIG. 17, first it is selected in step S1 whether or not to give the wavy shape to the recording paper P. When the recording paper P is guided onto the upper discharge tray 32, the recording paper P does not have to be waved, and therefore the procedure shifts to step S2. In the step S2, the gates 48 are moved to the second changeover position from the first changeover position. Moreover, upon receiving the command from the controller 12, the solenoid 98 is on standby.

In the next step S3, the recording paper P conveyed through the conveyance passage 5 is detected. When the tip end of the recording paper P contacts the actuator 11 of the paper discharge guide 9, the actuator 11 rotates to the detection position from the standby position. By this rotation, the photosensor 10 optically detects that the recording paper P reaches the downstream end of the conveyance passage 5, and sends the control signal to the controller 12.

In the next step S4, upon receiving the command from the controller 12, the solenoid 98 turns ON. Thereby, the plunger 101 of the solenoid 98 is retired, and the L-shaped link 99 rotates against the spring force of the return spring 102 in the clockwise direction. Thereby, the guide shaft 91 rotates in the clockwise direction, and the press members 92 on the guide shaft 91 are moved to the press release position from the press position as shown in FIG. 15. Thereby, the recording paper P is guided into the roller unit 23 without contacting the press surfaces 95, and discharged from the paper discharge port 6 via the roller unit 23. Therefore, the wavy shape is not given to the recording paper P. The tip end of the recording paper P is guided into the guide passage 35 by the edges 48*a* of the gates 48.

In the next step S5, it is detected whether or not the rear end of the recording paper P conveyed through the conveyance passage 5 passes through the paper discharge guide 9. When the recording paper P passes through the paper discharge guide 9, the actuator 11 returns to the standby position from the detection position. Therefore, the photosensor 10 sends the control signal indicating the passage of the recording paper P to the controller 12. When the actuator 11 is held in the detection position, the controller 12 judges that there is a problem in the conveyance of the recording paper P, and the procedure advances to step S6. In the step S6, the error is displayed in the display (not shown) of the image forming apparatus 1, indicating that the problem has arisen in the conveyance of the recording paper P.

When the passage of the recording paper P through the paper discharge guide 9 is detected in the step S5, the procedure advances to step S7. In the step S7, the controller 12 counts the constant pulses. Thereby, the required standby time is measured from when the rear end of the recording paper P passes through the paper discharge guide 9 until the paper passes through the discharge roller unit 38.

In the next step S8, the solenoid 98 is turned OFF by the command from the controller 12. Therefore, the press members 92 return to the press position from the press release position. Moreover, the gates 48 are moved to the first changeover position from the second changeover position. Thereby, the conveyance of one recording sheet P is completed.

When the recording paper P is guided onto the lower discharge tray 31, the recording paper P needs to be waved, and therefore the procedure shifts to step S9 from the step S1. In the step S9, the solenoid 98 keeps OFF state, and the gates 48 are held in the first changeover position. Therefore, as shown in FIG. 14, the press members 92 are held in the press position, and the press surfaces 95 jut out in the conveyance passage 5. As a result, the press surfaces 95 are pressed onto the plurality of portions of the recording paper P passed through the paper discharge guide 9 from below. Thereby, the upward pressure is applied to the recording paper P, and the wavy shape is given to the recording paper P. Therefore, the recording paper P temporarily becomes rigid, and is stacked onto the lower discharge tray 31 in the orderly aligned state.

According to the constitution, when the recording paper P is guided into the guide passage 35 bent in a crank shape, the recording paper P is not waved. Therefore, when the recording paper P passes through the guide passage 35, the unnecessary force is not applied to the recording paper P. Therefore, the recording paper P can be prevented from abnormally sounding as if something were broken.

Furthermore, the press surfaces 95 of the press members 92 press the recording paper P in the position deviating toward the upstream side along the conveyance direction of the recording paper P from the driven rollers 29. Therefore, the recording paper P is smoothly conveyed in the downstream end of the conveyance passage 5. In other words, if the press surfaces 95 are positioned on the downstream side from the driven rollers 29 along the conveyance direction of the recording paper P, the recording paper P discharged from the roller unit 23 rides onto the press surfaces 95. Therefore, the smooth conveyance of the recording paper P is inhibited, and the jamming is caused.

Therefore, the press members 92 are preferably disposed in the position deviating toward the upstream side from the contact portions of the recording paper P and driven rollers 29.

Figure 18:
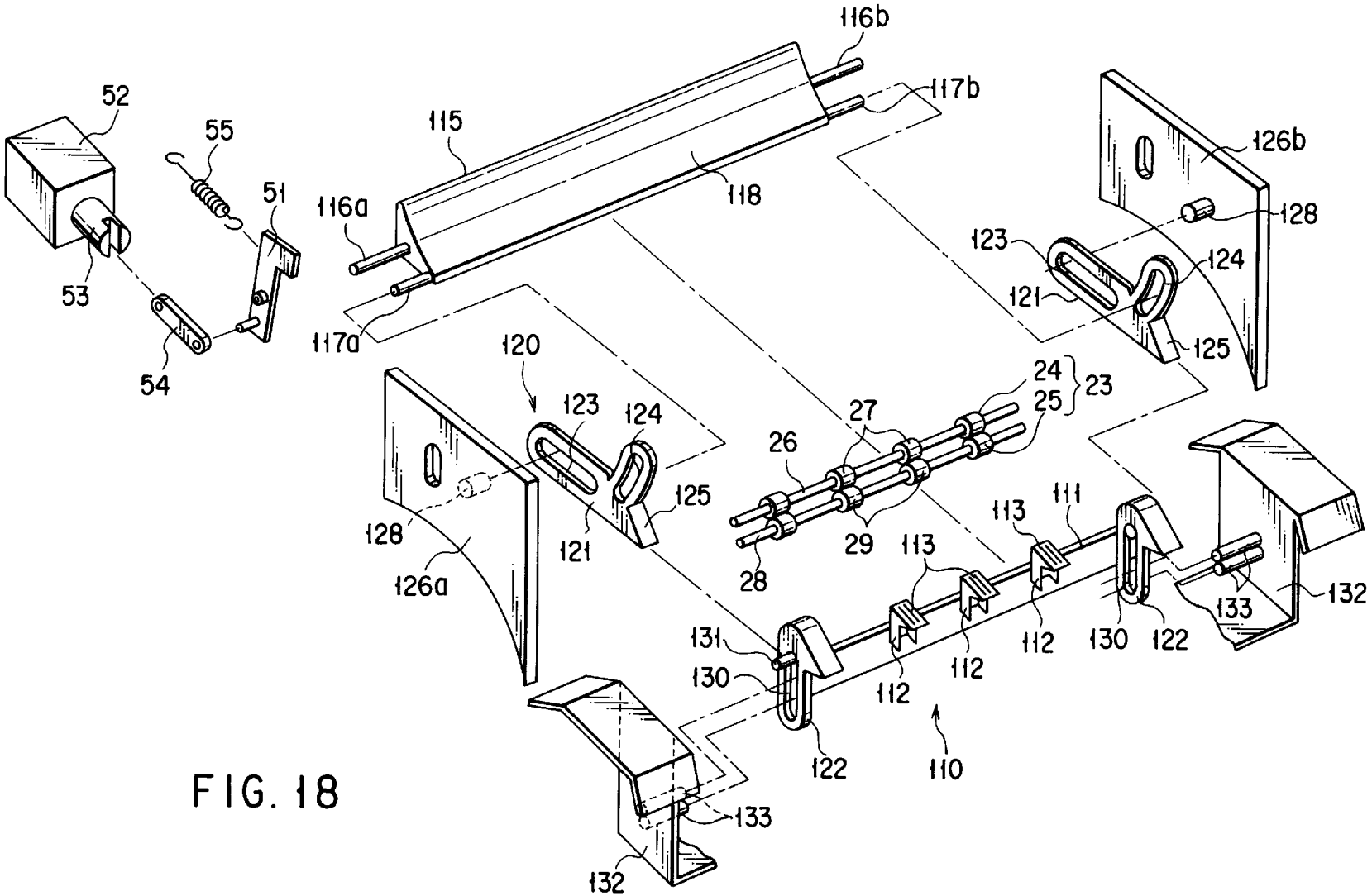
FIG. 18 is a perspective view showing a position relation of the gate, pressing mechanism and roller unit in a third embodiment of the present invention.
Figure 19:
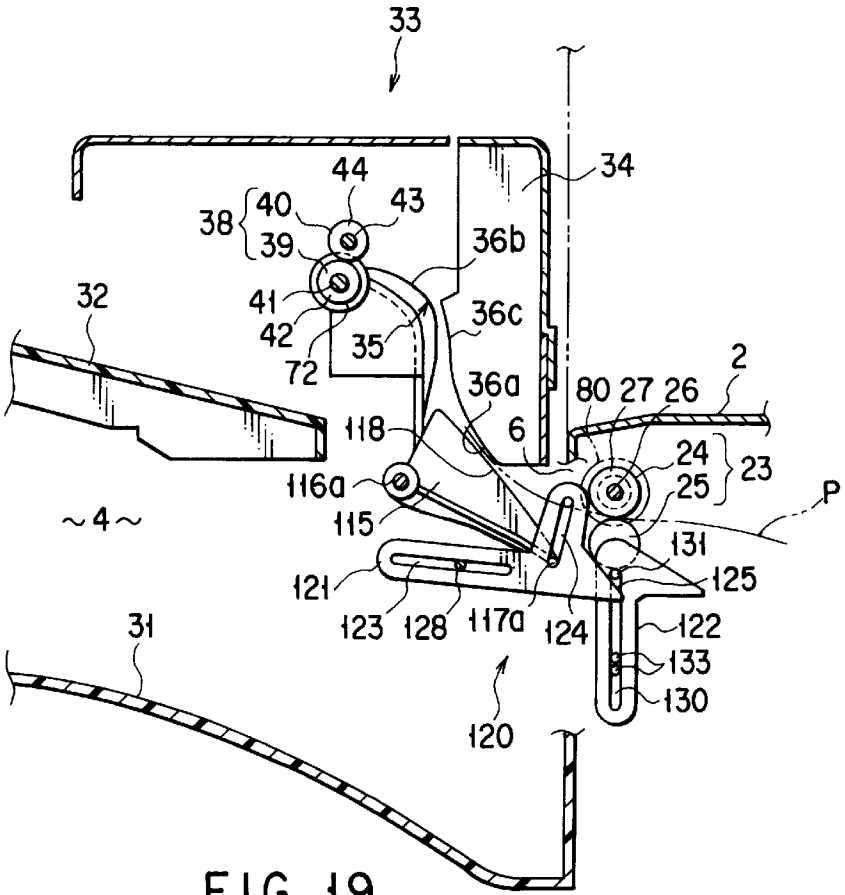
FIG. 19 is a sectional view of the image forming apparatus showing that the gate is switched to the second changeover position in the third embodiment of the present invention.
Figure 20:
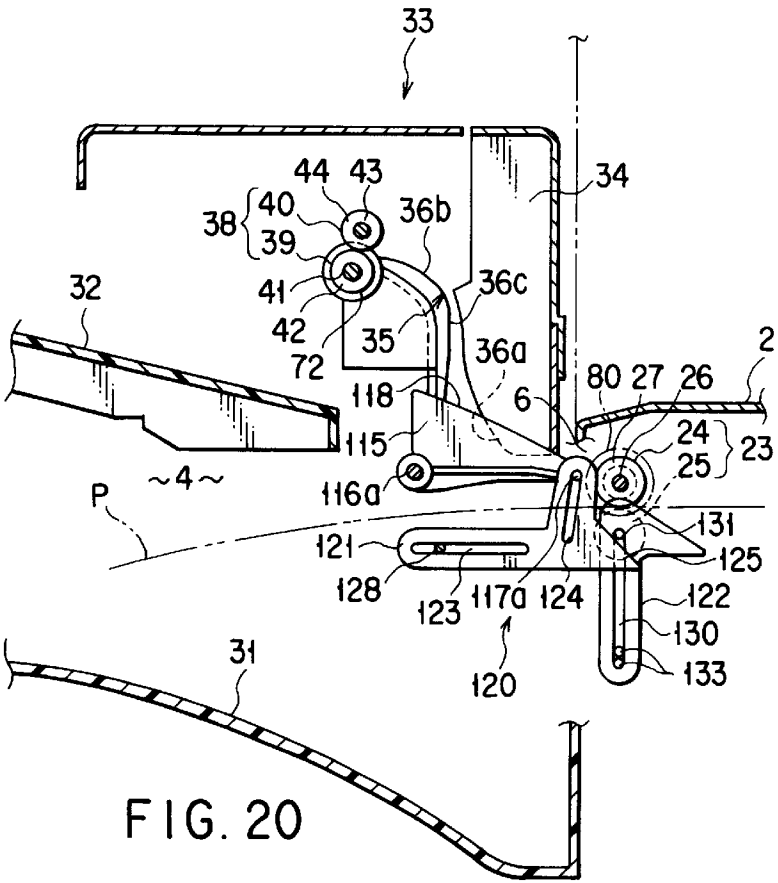
FIG. 20 is a sectional view of the image forming apparatus showing that the gate is switched to the first changeover position in the third embodiment of the present invention.

FIGS. 18 to 20 show a third embodiment of the present invention. The third embodiment is different from the first embodiment in the constitution of a press mechanism 110 for giving the wavy shape to the recording paper P. The basic constitution of the image forming apparatus 1 excluding the press mechanism 110 is similar to that of the first embodiment. Therefore, in the third embodiment, the same constituting components as those of the first embodiment are denoted with the same reference numerals, and the description thereof is omitted.

As shown in FIG. 18, the press mechanism 110 includes a guide frame 111 and a plurality of press members 112. The guide frame 111 is positioned below the roller unit 23, and disposed in parallel to the roller shaft 28 of the second roller group 25. The press members 112 are fixed to the guide frame 111. These press members 112 are disposed at intervals in the longitudinal direction of the guide frame 111. A press surfaces 113 are formed on the upper ends of the press members 112. The press surfaces 113 are positioned between the driven rollers 29 disposed adjacent to each other.

A gate 115 for changing the discharge direction of the recording paper P is horizontally disposed along the direction crossing at right angles to the conveyance direction of the recording paper P. The gate 115 includes a pair of support shafts 116*a*, 116*b*, a pair of guide pins 117*a*, 117*b* and a guide surface 118 for guiding the recording paper P upwards.

The support shaft 116*a* projects from one end of the gate 115. The support shaft 116*b* projects from the other end of the gate 115. The support shafts 116*a*, 116*b* are coaxially disposed, and are arranged in parallel to the roller shaft 28. These support shafts 116*a*, 116*b* are rotatably supported by the separator unit 33. The support shaft 116*a* is connected to the plunger 53 of the solenoid 52 via the L-shaped link 51 and arm 54. Therefore, the gate 115 can rotate over the first and second changeover positions by the solenoid 52. The gate 115 is constantly biased toward the first changeover position by the return spring 55. This respect is the same as the first embodiment.

The guide pin 117*a* projects from one end of the gate 115, and is disposed in parallel to the support shaft 116*a*. The guide pin 117*b* projects from the other end of the gate 115, and is disposed in parallel to the support shaft 116*b*. These guide pins 117*a*, 117*b* deviate from the support shafts 116*a*, 116*b* toward the paper discharge port 6.

The separator unit 33 has a link mechanism 120. The link mechanism 120 connects the gate 115 to the press mechanism 110. The link mechanism 120 includes a pair of first links 121 and a pair of second links 122. The first links 121 are disposed opposite to each other via the gate 115. The first links 121 have first guide holes 123, second guide holes 124 and cam surfaces 125. The first guide holes 123 horizontally extend along the discharge direction of the recording paper P. The second guide holes 124 extend in the vertical direction crossing at right angles to the discharge direction of the recording paper P, and are curved in the circular arc shapes. The cam surfaces 125 are positioned in the tip ends of the first links 121. The cam surfaces 125 are inclined downwards.

The first links 121 are disposed between a pair of side plates 126*a*, 126*b*. The side plates 126*a*, 126*b* are fixed to the separator unit 33. The side plates 126*a*, 126*b* have guide pins 128 projecting toward the first links 121. The guide pins 128 are slidably inserted in the first guide holes 123 of the first links 121. Furthermore, the guide pins 117*a*, 117*b* of the gate 115 are slidably inserted in the second guide holes 124 of the first links 121. Therefore, the first links 121 can horizontally move along the discharge direction of the recording paper P, and can rotate on the guide pins 128 as the fulcrum.

The second links 122 are disposed below the driven rollers 29 of the roller unit 23. The second links 122 are fixed to the guide frame 111 of the press mechanism 110, and are disposed opposite to each other via the press members 112. Each second link 122 has a guide hole 130. The guide holes 130 extend in the vertical direction. Guide pins 131 horizontally project from the upper end of the guide hole 130, and are disposed in parallel to the support shafts 116*a*, 116*b* of the gate 115.

The second links 122 are disposed between a pair of frames 132. The frames 132 are disposed opposite to each other via the press mechanism 110, and fixed to the separator unit 33. Each of the frames 132 has two guide pins 133. The guide pins 133 horizontally project toward the second links 122, and are slidably inserted in the guide holes 130 of the second links 122. Therefore, the second links 122 are supported in the frames 132 so that the links can rise/lower. Thereby, the press members 112 of the press mechanism 110 can move over the press position in which the press surfaces 113 jut out in the conveyance passage 5 and the press release position in which the press surfaces 113 retreats downwards in the conveyance passage 5. The guide pins 131 of the second links 122 are superposed upon the cam surfaces 125 of the first links 121.

An operation of the press mechanism 110 will next be described. FIG. 19 shows that the gate 115 is rotated to the second changeover position. When the gate 115 is rotated toward the second changeover position, the guide pins 117*a*, 117*b* on the tip end of the gate 115 move downwards along the second guide holes 124 of the first links 121. Thereby, the first links 121 are guided by the guide pins 128 and slide apart from the second links 122. Additionally, the first links 121 slightly rotate on the guide pins 128 as the fulcrum in the clockwise direction of FIG. 19.

As a result, the cam surfaces 125 of the first links 121 move apart from the guide pins 131 of the second links 122. Therefore, the guide pins 131 lower along the cam surfaces 125, and the second links 122 move downwards. Thereby, the press mechanism 110 moves to the press release position apart from the roller unit 23. In the press release position, the press surfaces 113 of the press members 112 retreat from the conveyance passage 5. Therefore, as long as the gate 115 is in the second changeover position, the press surfaces 113 are not pressed onto the recording paper P.

FIG. 20 shows that the gate 115 is rotated to the first changeover position. When the gate 115 is rotated toward the first changeover position, the guide pins 117*a*, 117*b* on the tip end of the gate 115 rises along the second guide holes 124 of the first links 121. Thereby, the first links 121 are guided by the guide pins 128 and slide close to the second links 122. Additionally, the first links 121 slightly rotate on the guide pins 128 as the fulcrum in the counterclockwise direction of FIG. 20.

As a result, the cam surfaces 125 of the first links 121 move close to the guide pins 131 of the second links 122. Therefore, the guide pins 131 are pushed up by the cam surfaces 125, and the second links 122 move upwards. Thereby, the press mechanism 110 moves to the press position right under the roller unit 23. In the press position, the press surfaces 113 of the press members 112 jut out in the conveyance passage 5, and are pressed onto the plurality of portions of the recording paper P from below. Therefore, as long as the gate 115 is in the first changeover position, the press surface 113 give the wavy shape to the recording paper P guided by the roller unit 23.

According to the constitution, when the recording paper P is guided into the guide passage 35 bent in the crank shape, the gate 115 is held in the second changeover position, and therefore the recording paper P is not waved. Therefore, when the recording paper P passes through the guide passage 35, the unnecessary force is not applied to the recording paper P. The recording paper P can be prevented from abnormally sounding as if something were broken.

In the present invention, the means for driving the gate is not limited to the solenoid. For example, a motor including a decelerator may also be used instead of a solenoid.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A sheet discharge apparatus comprising:

a conveyance passage to convey a sheet;

a plurality of stackers on which said sheet is stacked after being discharged from said conveyance passage;

a gate which changes a discharge direction of said sheet discharged from said conveyance passage, and which is able to move to a first changeover position to guide said sheet to a first stacker, and a second changeover position to guide said sheet to a second stacker;

a guide passage having a bent shape, to guide said sheet to said second stacker when said gate is moved to said second changeover position; and a press mechanism which is disposed upstream of said gate along a conveyance direction of said sheet, and which is able to move to a press position in which the press mechanism applies a pressure and gives a wavy shape to said sheet, and a press release position in which the press mechanism is detached from said sheet; and a cooperation mechanism which conveys the movement of said gate to said press mechanism, wherein said cooperation mechanism moves said press mechanism to said press position when said gate is in said first changeover position, and moves said press mechanism to said press release position when said gate is in said second changeover position.

2. The sheet discharge apparatus according to claim 1, further comprising a second press mechanism disposed in a downstream end of said guide passage, wherein said said second press mechanism applies a pressure and gives a wavy shape to said sheet discharged to said second stacker from said guide passage, and temporarily makes said sheet rigid.

3. The sheet discharge apparatus according to claim 1, wherein said first stacker is provided at a position lower than a downstream end of said conveyance passage, said second stacker is provided at a position higher than the downstream end of said conveyance passage, and said guide passage extends upwards from the downstream end of said conveyance passage and includes a plurality of corner portions midway in said guide passage.

4. The sheet discharge apparatus according to claim 1, wherein said conveyance passage includes a pair of roller groups in the downstream end of said conveyance passage which hold and convey said sheet, said press mechanism includes a press surface pressed onto said sheet, and the press surface gives the wavy shape to said sheet in a position deviating toward the upstream side along the conveyance direction of said sheet from a contact portion of said roller groups and said sheet.

5. The sheet discharge apparatus according to claim 1, wherein said conveyance passage has a roller unit in a downstream end of said conveyance passage which discharges said sheet, said press mechanism includes a pair of roller groups which hold said sheet and a plurality of press rollers disposed coaxially with one of said pair of roller groups and pressed onto said sheet, and said press mechanism is positioned between said roller unit and said gate.

6. A sheet discharge apparatus comprising:

a conveyance passage to convey a sheet;

a roller disposed in a downstream end of said conveyance passage and having an outer peripheral surface in contact with said sheet;

a stacker on which said sheet is stacked after being discharged from said conveyance passage; and an annular pressing member which is attached to the outer peripheral surface of said roller, and which is movable to one of a first position from which the outer peripheral surface of said roller juts out and a second position from which the outer peripheral surface of said roller retreats, wherein said annular pressing member applies a pressure and gives a wavy shape to said sheet, and temporarily makes the sheet rigid, when said pressing member is moved to said first position.

7. The sheet discharge apparatus according to claim 6, wherein said press mechanism comprises an elastically deformable O ring, said roller includes a first attachment groove and a second attachment groove to which said O ring is detachably attached in the outer peripheral surface of the roller, said second attachment groove is deeper than said first attachment groove, the O ring is held in said second position as long as the O ring is attached to said second attachment groove, and the O ring is held in said first position as long as the O ring is attached to said first attachment groove.

8. The sheet discharge apparatus according to claim 6, wherein said roller includes an end surface connected to the outer peripheral surface of said roller, and a plurality of cutouts opened in the outer peripheral surface and the end surface, and wherein the cutouts are disposed at intervals in a peripheral direction of said roller and are connected to said second attachment groove.

9. An image forming apparatus comprising:

an apparatus body in which an image processing mechanism is disposed to form an image on a sheet;

a conveyance passage which is disposed in said apparatus body, and through which said sheet with the image formed thereon is conveyed;

a plurality of stackers which are disposed in said apparatus body, and on which said sheet is stacked after being discharged from said conveyance passage;

a gate which changes a discharge direction of said sheet discharged from said conveyance passage, and which is able to move to a first changeover position to guide said sheet to a first stacker, and a second changeover position to guide said sheet to second stacker;

a guide passage which guides said sheet to said second stacker when said gate is moved to said second changeover position, wherein said guide passage has a bent shape; and a press mechanism which is disposed upstream of said gate along a conveyance direction of said sheet, and which is able to move to a press position in which said press mechanism applies a pressure and gives a wavy shape to said sheet, and a press release position in which said press mechanism is detached from said sheet; and a cooperation mechanism which conveys a movement of said gate to said press mechanism, wherein said cooperation mechanism moves said press mechanism to said press position when said gate is in said first changeover position, and moves said press mechanism to said press release position when said gate is in said second changeover position.

10. The image forming apparatus according to claim 9, further comprising:

a second press mechanism disposed in a downstream end of said guide passage, wherein said second press mechanism applies a pressure and gives a wavy shape to said sheet discharged to said second stacker from said guide passage, and temporarily makes said sheet rigid.

11. The image forming apparatus according to claim 9, wherein said first stacker is provided at a position lower than a downstream end of said conveyance passage, said second stacker is provided at a position higher than the downstream end of said conveyance passage, and said guide passage extends upwards from the downstream end of said conveyance passage and includes a plurality of corner portions midway in said guide passage.

12. An image forming apparatus comprising:

an apparatus body in which an image processing mechanism is disposed to form an image on a sheet;

a conveyance passage which is disposed in said apparatus body, and through which said sheet with the image formed thereon is conveyed;

a roller which is disposed in a downstream end of said conveyance passage, and which includes an outer peripheral surface in contact with said sheet;

first and second stackers which are disposed in said apparatus body, and on which said sheet discharged from said conveyance passage is stacked;

a separator unit detachably supported by said apparatus body, said separator unit including:

a guide passage which connects said second stacker to a downstream end of said conveyance passage, and which has a bent shape; and a gate which can move to a first changeover position to guide said sheet discharged from said conveyance passage to said first stacker, and a second changeover position to guide said sheet discharged from said conveyance passage to said second stacker via said guide passage;

a press mechanism which is disposed between said roller and said gate, and which is able to move to a press position in which said press mechanism applies a pressure and gives a wavy shape to said sheet discharged from said conveyance passage, and a press release position in which said press mechanism is detached from said sheet; and a cooperation mechanism which conveys a movement of said gate to said press mechanism, wherein said cooperation mechanism moves said press mechanism to said press position when said gate is in said first changeover position, and moves said press mechanism to said press release position when said gate is in said second changeover position; and an annular pressing member which is attached to the outer peripheral surface of said roller, and which is movable to one of a first position from which the outer peripheral surface of said roller juts out and a second position from which the outer peripheral surface of said roller retreats, wherein said annular pressing member is moved to said first position when said separator unit is removed from said apparatus body and applies a pressure and gives a wavy share discharged from the downstream end of said conveyance passage and temporarily makes said sheet rigid.

13. The image forming apparatus according to claim 12, wherein said apparatus body includes a paper discharge chamber therein, and said stackers are disposed in said paper discharge chamber.

14. The image forming apparatus according to claim 12, wherein said first stacker is provided at a position lower than the downstream end of said conveyance passage, said second stacker and said separator unit are provided at a position higher than the downstream end of said conveyance passage, and said guide passage of said separator unit extends upwards from the downstream end of said conveyance passage and includes a plurality of corner portions midway in said guide passage.

15. The image forming apparatus according to claim 12, wherein said separator unit includes a second press mechanism in the downstream end of said guide passage, and said second press mechanism applies the pressure and gives the wavy shape to said sheet discharged to said second stacker from said guide passage, and temporarily makes said sheet rigid.

16. The image forming apparatus according to claim 12, wherein said press mechanism includes a pair of roller groups which hold said sheet and a plurality of press rollers disposed coaxially with one roller group and pressed onto said sheet, and wherein said press mechanism is positioned between said roller unit and said gate.

17. A sheet discharge apparatus comprising:

a conveyance passage to convey a sheet;

a plurality of stackers on which said sheet is stacked after being discharged from said conveyance passage;

a gate which changes a discharge direction of said sheet discharged from said conveyance passage, and which is movable to a first changeover position to guide said sheet to a first stacker, and a second changeover position to guide said sheet to a second stacker;

a guide passage to guide said sheet to said second stacker when said gate is moved to said second changeover position, wherein said guide passage has a bent shape;

a first press mechanism which is disposed upstream of said gate along a conveyance direction of said sheet, and which is movable to a press position in which said first press mechanism applies a pressure and gives a wavy shape to said sheet, and a press release position in which said first press mechanism is detached from said sheet;

a cooperation mechanism which conveys a movement of said gate to said first press mechanism, wherein said cooperation mechanism moves said first press mechanism to said press position when said gate is in said first changeover position and moves said first press mechanism to said press release position when said gate is in said second changeover position; and a second press mechanism disposed in a downstream end of said guide passage, wherein said second press mechanism applies a pressure and gives a wavy shape to said sheet discharged to said second stacker from said guide passage.

18. A sheet discharge apparatus comprising:

a conveyance passage to convey a sheet;

a plurality of stackers on which said sheet is stacked after being discharged from said conveyance passage;

a gate which changes a discharge direction of said sheet discharged from said conveyance passage, and which is movable to a first changeover position to guide said sheet to a first stacker, and a second changeover position to guide said sheet to a second stacker;

a guide passage to guide said sheet to said second stacker when said gate is moved to said second changeover position, wherein said guide passage has a bent shape;

a press mechanism which is disposed upstream of said gate along a conveyance direction of said sheet, and which is movable to a press position in which said press mechanism applies a pressure and gives a wavy shape to said sheet, and a press release position in which said press mechanism is detached from said sheet; and a driving device which moves said press mechanism to said press position when said gate is in said first changeover position, and which moves said press mechanism to said press release position when said gate is in said second changeover position.

19. A separator unit which is removably attached to an apparatus body that includes a conveyance passage which conveys a sheet and a plurality of stackers on which said sheet is stacked after being discharged from said conveyance passage, said separator unit comprising:

a gate which changes a discharge direction of said sheet discharged from said conveyance passage, and which is movable to a first changeover position to guide said sheet to a first stacker, and a second changeover position to guide said sheet to a second stacker;

a guide passage which guides said sheet to said second stacker when said gate is moved to said second changeover position, wherein said guide passage has a bent shape;

a press mechanism which is disposed upstream of said gate along a conveyance direction of said sheet, and which is movable to a press position in which said press mechanism applies a pressure and gives a wavy shape to said sheet, and a press release position in which said press mechanism is detached from said sheet; and a cooperation mechanism which conveys a movement of said gate to said press mechanism, wherein said cooperation mechanism moves said press mechanism to said press position when said gate is in said first changeover position and moves said press mechanism to said press release position when said gate is in said second changeover position.

20. The separator unit according to claim 19, further comprising a second press mechanism disposed in a downstream end of said guide passage;

wherein said press mechanism applies a pressure and gives a wavy shape to said sheet discharged to said second stacker from said guide passage and temporarily makes the sheet rigid.

21. The separator unit according to claim 19, wherein said guide passage extends upwards from the downstream end of said conveyance passage and includes a plurality of corner portions midway in said guide passage.

* * * * *